US006845001B1

(12) United States Patent
Kinbara

(10) Patent No.: US 6,845,001 B1
(45) Date of Patent: Jan. 18, 2005

(54) ELECTROMAGNETIC CONTACTOR

(75) Inventor: Yoshihide Kinbara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/030,536

(22) PCT Filed: Jul. 12, 1999

(86) PCT No.: PCT/JP99/03745

§ 371 (c)(1),
(2), (4) Date: Jan. 11, 2002

(87) PCT Pub. No.: WO01/04922

PCT Pub. Date: Jan. 18, 2001

(51) Int. Cl.[7] ..... H01H 47/00
(52) U.S. Cl. ..... 361/152; 361/154; 361/160
(58) Field of Search ..... 361/152, 154, 361/160, 185, 187, 2, 205

(56) References Cited

U.S. PATENT DOCUMENTS 4,720,761 A * 1/1988 Saletta et al. ..... 361/152
4,720,763 A * 1/1988 Bauer ..... 361/154
4,833,565 A * 5/1989 Bauer et al. ..... 361/154
5,684,668 A 11/1997 Muramatsu et al. ..... 361/185

FOREIGN PATENT DOCUMENTS

| | | | |
|---|---|---|---|
| JP | 56-121232 | 9/1981 | ..... H01H/47/07 |
| JP | 61-240520 | 10/1986 | ..... H01H/47/32 |
| JP | 5-47280 | 2/1993 | ..... H01H/47/00 |
| JP | 8-185779 | 7/1996 | ..... H01H/47/22 |

* cited by examiner

*Primary Examiner*—Stephen W. Jackson
(74) *Attorney, Agent, or Firm*—Sughrue Mion, PLLC

(57) ABSTRACT

In an electromagnetic contactor 100 for passing a current through an electromagnet 301 from a power source 402 and moving a movable core 1 from a first position in which a gap to a fixed core 20 is wide to a second position in which the gap is narrow by electromagnetic force and opening or closing a contact, there is provided an attraction force control part 303 for passing a strong acceleration current E1 through the electromagnet 301 for a predetermined time so that acceleration in the second position of the movable core 1 becomes a predetermined value and passing a suction current E6 through the electromagnet 301 in substantially the second position.

14 Claims, 19 Drawing Sheets

ELECTROMAGNETIC CONTACTOR

TECHNICAL FIELD

This invention relates to an electromagnetic contactor, and suppresses a shock by a collision between a movable core and a fixed core occurring in the case of throwing and releasing the movable core by electromagnetic force.

BACKGROUND ART

An electromagnetic contactor will be described by FIG. 19. FIG. 19 is a sectional view showing a configuration of the electromagnetic contactor. In FIG. 19, an electromagnetic contactor 100 comprises a fixed part and a movable part, and in the fixed part, a base 10 is coupled to a mount 23 by screws through a trip spring 30 compressed and mounted between a crossbar 2 and the mount 23. A primary fixed contact 25 having a contact 12 and an auxiliary fixed contact 26 are fixed in the base 10, and a fixed core 20 is held within the mount 23 through a rubber plate 22 for shock absorption, and an arc box 11 is provided on the base 10. An electromagnet forms a coil 21 by winding electric wires on a bobbin 24 and is positioned around a leg part of the fixed core 20.

In the movable part, a movable core 1 is joined to the crossbar 2 held within the base 10 by a pin 3, and a primary movable contact 4 is fitted in an upper window of the crossbar 2 through a press spring 5 and a contact spring 6, and a contact 7 opposite to the primary fixed contact 25 is provided in the primary movable contact 4. An auxiliary movable contact 8 opposite to the auxiliary fixed contact 26 is fitted in a center window of the crossbar 2 by an auxiliary contact spring 9.

The electromagnetic contactor 100 moves the movable core 1 from a first position to a second position with respect to the fixed core 20 by turning on or off excitation of the electromagnet, and in a state in which the electromagnet is not excited, a position of the movable core 1 in a state in which a wide gap between suction surfaces of the movable core 1 and the fixed core 20 is ensured is called a first position (it may be called a second position), and in a state in which the electromagnet is excited, a position of the movable core 1 in a state in which the movable core 1 moves with respect to the fixed core 2 to become a narrow gap (including a contact state of the gap with zero) between the suction surfaces is called a second position (it may be called a first position). The throwing of the electromagnetic contactor 100 means that the movable core 1 moves from the first position to the second position, and the opening of the electromagnetic contactor 100 means that the movable core 1 moves from the second position to the first position. Then, in the first position of the movable core 1, the top of the inverted T-shaped crossbar 2 is contacted and pressed to the base 10 by the trip spring 30 and so on.

Next, an operation of the electromagnetic contactor 100 configured as mentioned above will be described by FIG. 19. When a voltage is thrown to the coil 21 and a current flows, the fixed core 20 is magnetized and electromagnetic attraction force occurs in a gap g between the fixed core 20 and the movable core 1, and the movable core 1 is attracted to the fixed core 20 against the trip spring 30 and the contact springs 6, 9 by the attraction force and moves from the first position to the second position and also, the contact 7 of the movable contact 4 contacts and presses to the contact 12 of the fixed contact 25.

On the other hand, when the current of the coil 21 is broken, the fixed core 20 is demagnetized, so that the movable core 1 is released from suction and moves from the second position to the first position and also, the contact 7 and the contact 12 are opened.

However, in the configuration of the above-mentioned electromagnetic contactor 100, by the throwing or breaking of the current of the coil 21, the movable core 1 has a high collision speed to the fixed core 2 and repeats bounce operations for a while. Due to vibration associated with such a repeat, so-called chattering in which the contact 7 of the primary movable contact 4 and the contact 12 of the primary fixed contact 25 connect or disconnect for a short time is generated.

Therefore, there were problems that a large shock sound occurs from the movable core 1, the fixed core 20, the crossbar 2, the base 10, etc. by the above-mentioned throwing or breaking and dust occurs from the movable core 1 etc. or repeat shocks are applied to the crossbar 2, the base 10 and so on.

DISCLOSURE OF THE INVENTION

This invention is implemented to solve the problems, and an object of the invention is to provide an electromagnetic contactor for suppressing a shock occurring in the case of throwing and opening.

In order to achieve this object, an electromagnetic contactor of a first aspect is characterized in that in an electromagnetic contactor for performing switching of a contact by controlling energization of an electromagnet to move a movable core from a first position to a second position with respect to a fixed core, there is provided attraction force control means for controlling an integral value of a current flowing through the electromagnet so that acceleration in the second position of the movable core becomes a predetermined value or less.

An electromagnetic contactor of a second aspect is characterized in that in an electromagnetic contactor for passing a current through an electromagnet from a power source and moving a movable core from a first position in which a gap to a fixed core is wide to a second position in which the gap is narrow by electromagnetic force and opening or closing a contact, there is provided attraction force control means for passing a first current through the electromagnet for a predetermined time so that acceleration in the second position of the movable core becomes a predetermined value and passing a second current through the electromagnet in substantially the second position.

An electromagnetic contactor of a third aspect is characterized in that in an electromagnetic contactor for breaking a current flowing through an electromagnet from a power source and moving a movable core from a second position in which a gap to a fixed core is narrow to a first position in which the gap is wide and opening or closing a contact, there is provided attraction force control means for breaking the current flowing through the electromagnet and then passing a deceleration current through the electromagnet for a predetermined time so that acceleration in the first position of the movable core becomes a predetermined value.

An electromagnetic contactor of a fourth aspect is characterized in that in an electromagnetic contactor for passing a current through an electromagnet from a power source and moving a movable core from a first position in which a gap to a fixed core is wide to a second position in which the gap is narrow by electromagnetic force and opening or closing a contact, there are provided current control means for controlling the current flowing through the electromagnet, and command means for passing a first current through the electromagnet for a predetermined time by this current control means to break the current and then passing a second current through the electromagnet by the current control means at the time when the movable core moves to substantially the second position after a lapse of a predetermined time.

An electromagnetic contactor of a fifth aspect is characterized in that in an electromagnetic contactor for breaking a current flowing through an electromagnet from a power source and moving a movable core from a second position in which a gap to a fixed core is narrow to a first position in which the gap is wide and opening or closing a contact, there are provided current control means for controlling the current flowing through the electromagnet, and command means for breaking the current flowing through the electromagnet by the current control means and then passing a deceleration current through the electromagnet for a predetermined time by the current control means after a predetermined time and breaking the deceleration current by the current control means at the time when the movable core moves to substantially the first position.

A value of a second current of an electromagnetic contactor of a sixth aspect passes a holding current value through an electromagnet by current control means after passing a current higher than the holding current value necessary to hold the movable core in a second position through the electromagnet for a predetermined time by the current control means.

An electromagnetic contactor of a seventh aspect is characterized in that in an electromagnetic contactor for passing a current through an electromagnet from a power source and moving a movable core from a first position in which a gap to a fixed core is wide to a second position in which the gap is narrow by electromagnetic force and opening or closing a contact, there are provided current control means for controlling the current flowing through the electromagnet, and command means for passing a first current through the electromagnet for a predetermined time by this current control means and then passing a second current having a value lower than the first current through the electromagnet for a predetermined time by the current control means at a point in time when the movable core approaches the second position and then passing a third current through the electromagnet by the current control means at a point in time when the movable core moves to substantially the second position.

An electromagnetic contactor of an eighth aspect is characterized in that in an electromagnetic contactor for breaking a current flowing through an electromagnet from a power source and moving a movable core from a second position in which a gap to a fixed core is narrow to a first position in which the gap is wide and opening or closing a contact, there are provided current control means for controlling the current flowing through the electromagnet, and command means for breaking the current flowing through the electromagnet by the current control means and then passing a first deceleration current through the electromagnet for a predetermined time by the current control means after a lapse of a predetermined time and passing a second deceleration current for a predetermined time by the current control means at a point in time when the movable core approaches the first position and then breaking the second deceleration current by the current control means at a point in time when the movable core moves to substantially the first position.

A command of command means or electromagnetic force control means of an electromagnetic contactor of a ninth aspect is characterized by having a predetermined slope in a rise or a fall of a current.

An electromagnetic contactor of a tenth aspect is characterized in that in an electromagnetic contactor for passing a current through an electromagnet from an AC power source and moving a movable core from a first position in which a gap to a fixed core is wide to a second position in which the gap is narrow by electromagnetic force and opening or closing a contact, there is provided phase control means for shifting the AC power source from OFF to ON at a predetermined voltage phase based on a command of command means, and the command of the command means turns on the phase control means for a predetermined time and applies a voltage to the electromagnet and turns on the phase control means at a point in time when the movable core reaches substantially the second position after a lapse of a predetermined time.

An electromagnetic contactor of an eleventh aspect is characterized in that in an electromagnetic contactor for breaking a current through an electromagnet from an AC power source and moving a movable core from a second position in which a gap to a fixed core is narrow to a first position in which the gap is wide and opening or closing a contact, there are provided opening signal means for generating an opening signal for opening the electromagnetic contactor from closing, and phase control means for shifting the AC power source from ON to OFF at a predetermined voltage phase based on a command of command means and occurrence of the opening signal and also turning on or off irrespective of the voltage phase of the AC power source based on a signal of the command means after the opening signal occurs, and the command of the command means breaks a voltage of the electromagnet by the phase control means based on occurrence of the opening signal of the opening command means and then applies a voltage to the electromagnet for a predetermined time by the phase control means after a predetermined time and shifts the phase control means from ON to OFF at a point in time when the movable core reaches substantially the first position.

An electromagnetic contactor of a twelfth aspect is characterized in that in an electromagnetic contactor for breaking a current flowing through an electromagnet from a power source and moving a movable core from a first position in which a gap to a fixed core is wide to a second position in which the gap is narrow and opening or closing a contact, the electromagnet consists of a first electromagnet for exciting the fixed core and a second electromagnet for exciting the movable core, and there are provided current control means for controlling the current flowing through the first and second electromagnets, switching means for switching electromagnetic force occurring in the movable core and the fixed core to attraction or repulsion by switching a direction of the current flowing through the first or second electromagnet, and command means for passing a first attraction current through the first and second electromagnets for a predetermined time in an attraction direction of the movable core and the fixed core by the current control means and the switching means and then passing a first repulsion current through the first and second electromagnets for a predetermined time in a repulsion direction of the movable core and the fixed core by the current control means and the switching means at a point in time when the movable core approaches the second position and then passing the second attraction current through the first and second electromagnets in an attraction direction of the movable core and the fixed core by the current control means and the switching means at a point in time when the movable core moves to substantially the second position.

An electromagnetic contactor of a thirteenth aspect is characterized in that in an electromagnetic contactor for breaking a current flowing through an electromagnet from a power source and moving a movable core from a second position in which a gap to a fixed core is narrow to a first position in which the gap is wide and opening or closing a contact, the electromagnet consists of a first electromagnet for exciting the fixed core and a second electromagnet for exciting the movable core, and there are provided switching means for switching electromagnetic force occurring in the movable core and the fixed core to attraction or repulsion by switching a direction of the current flowing through the first or second electromagnet, and command means for passing a first repulsion current through the first and second electromagnets for a predetermined time in a repulsion direction of the movable core and the fixed core by the current control means and the switching means and then passing a first attraction current through the first and second electromagnets for a predetermined time in an attraction direction of the movable core and the fixed core by the current control means and the switching means and then breaking the first attraction current at a point in time when the movable core moves to substantially the first position.

BEST MODE FOR CARRYING OUT THE INVENTION

Next, in this invention, embodiments will be described as follows.

First Embodiment

Figure 1:
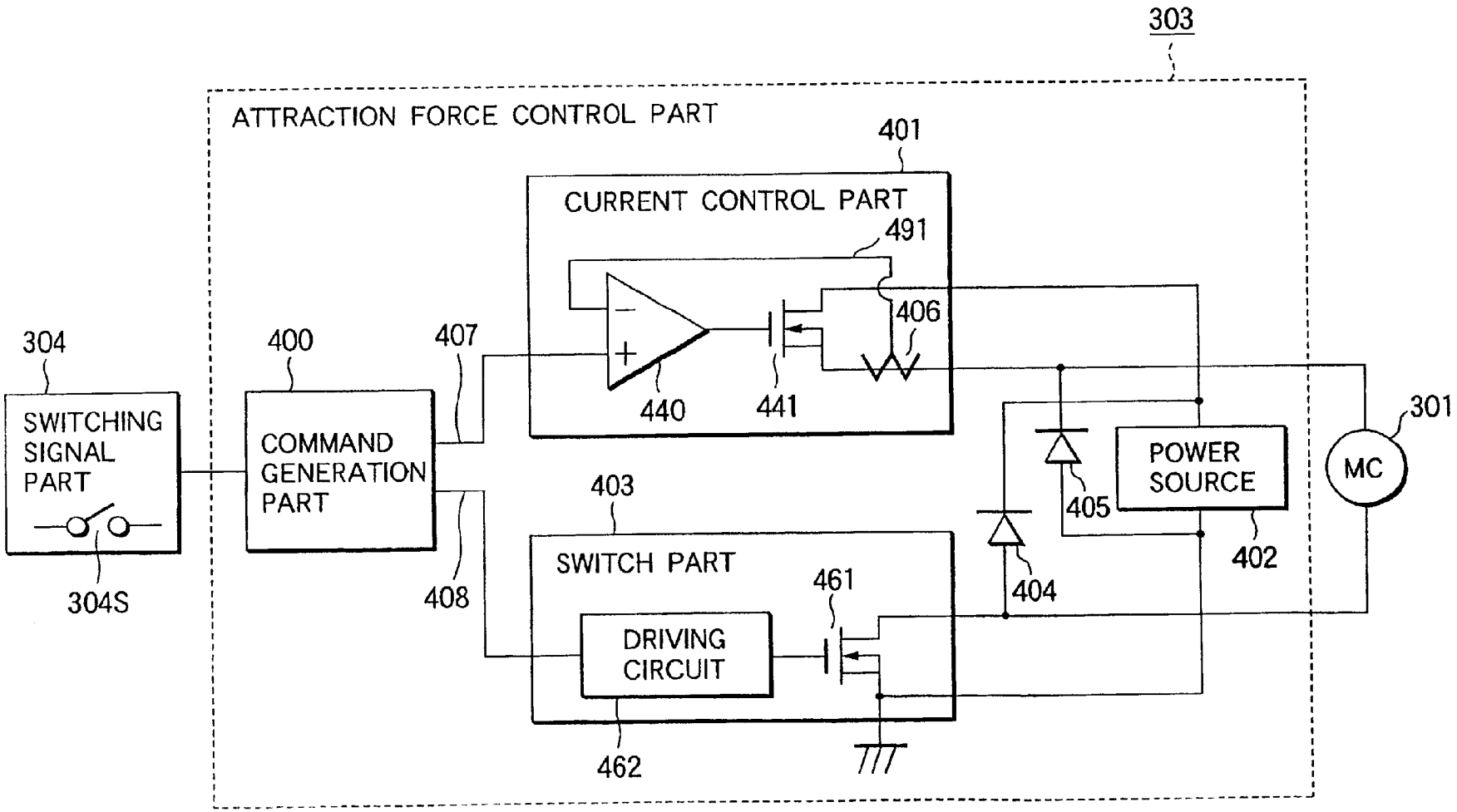
FIG. 1 is the entire block diagram of an electric portion of an electromagnetic contactor which is one embodiment of this invention.
Figure 2:
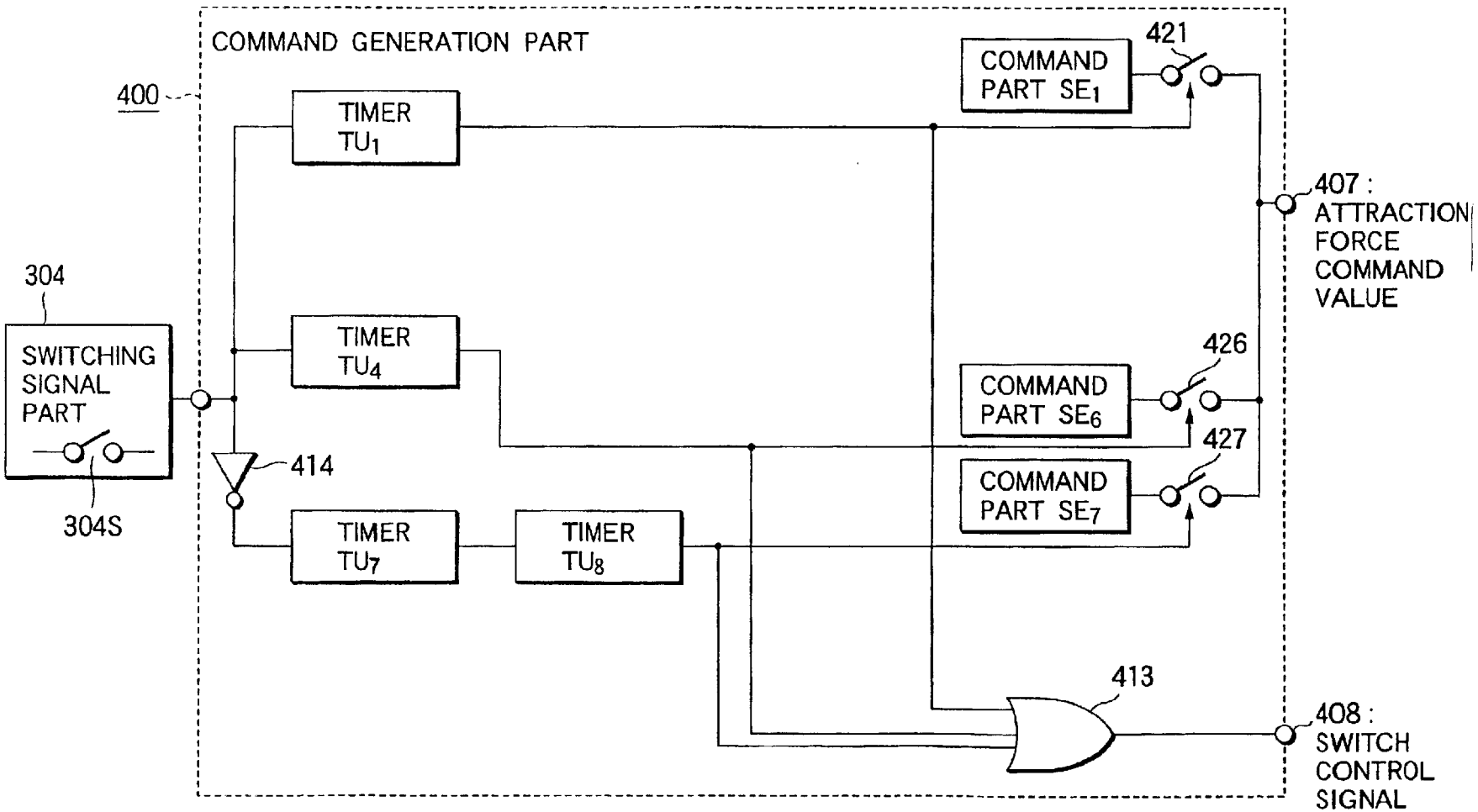
FIG. 2 is an internal circuit diagram of a command generation part shown in FIG. 1.
Figure 19:
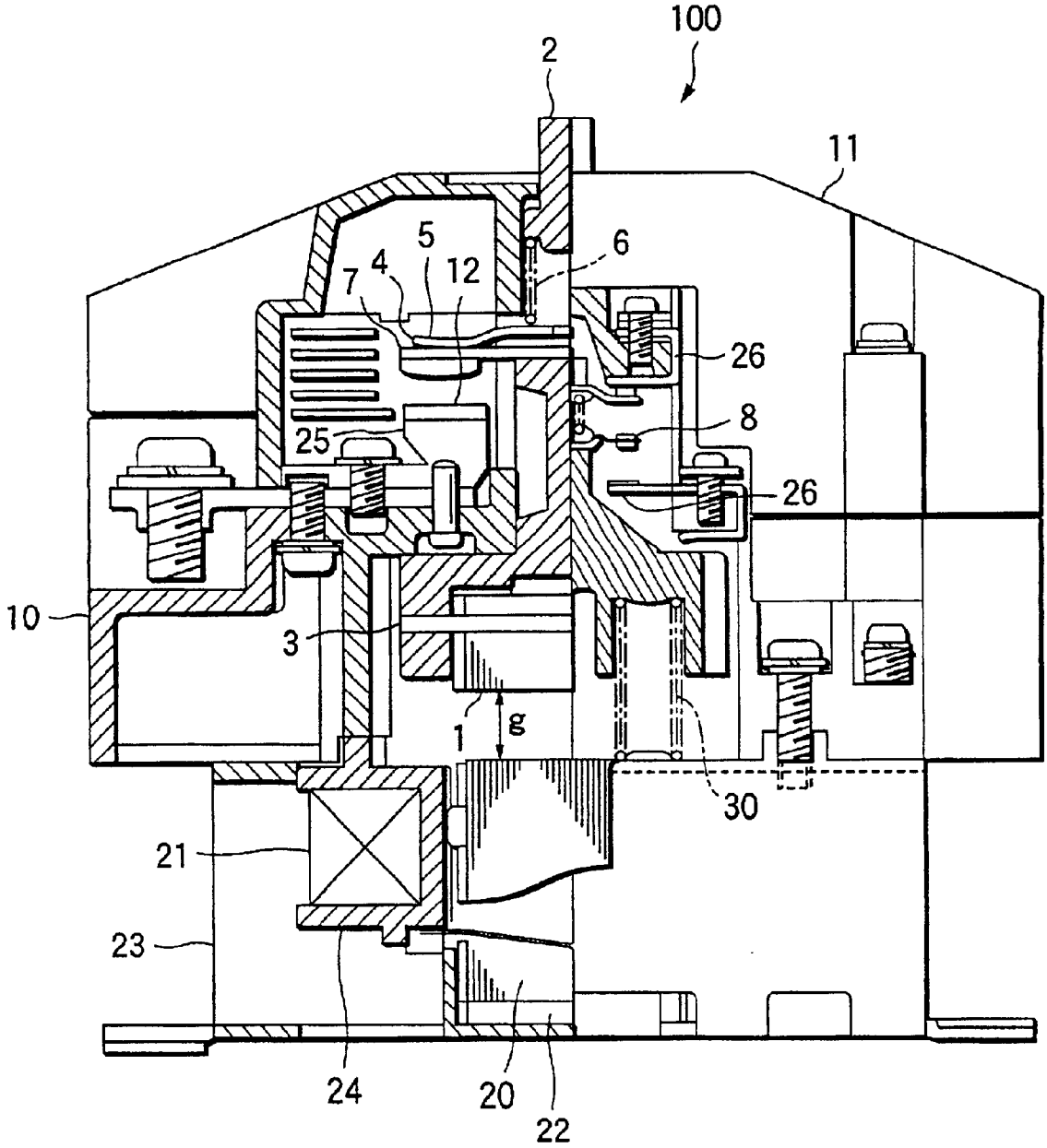
FIG. 19 is a sectional view of an electromagnetic contactor.

An embodiment of this invention will be described with reference to FIGS. 1 and 2. FIG. 1 is a block diagram showing the entire connection showing one embodiment of this invention, and FIG. 2 is a detailed internal circuit of a command generation part shown in FIG. 1. In FIGS. 1 and 2, there are provided a switching signal part 314 for generating a signal for throwing or opening a current of an electromagnet 301 (coil 21) of an electromagnetic contactor 100 shown in FIG. 19 by a switch 314S, and an attraction force control part 303 acting as attraction force control means for controlling electromagnetic attraction force of the electromagnet 301 by controlling an integral value of the current flowing through the electromagnet 301 by a switching signal from the switching signal part 314.

The attraction force control part 303 comprises a command generation part 400 acting as command means for generating an attraction command value 407 which becomes a command for controlling the current of the electromagnet 301 by the switching signal of the switching signal part 314, a current control part 401 for controlling the current flowing through the electromagnet 301 by a command signal from the command generation part 400, a switch part 403 for performing ON-OFF control of the current flowing through the electromagnet 301 by the command signal, and a DC power source 402 connected to outputs of the current control part 401 and the switch part 403.

The command generation part 400 comprises a timer TU1 for generating a pulse for passing a strong acceleration current E1 acting as a first acceleration current for time U1 by an ON (closing) signal of a switch 3045, a timer TU4 for generating a lag signal U4 of a steady-state current E6 by ON of the switch 304S, a timer TU7 for generating a lag signal U7 of a strong deceleration current E7 by an inversion signal in which an OFF (opening) signal of the switch 304S is inverted by a NOT circuit 414, and a timer TU8 for generating a pulse with time U8 based on a signal of the timer TU7.

It is constructed so that by connecting outputs of switches 421, 426, 427 for connecting command values of each command part SE1, SE6, SE7 to outputs based on each output signal of each the timer TU1, TU4, TU8, the command values of each the command part SE1, SE6, SE7 are inputted to the current control part 401 acting as current control means as an attraction force command value 407 and also the output signals of each the timer TU1, TU4, TU8 are inputted to the switch part 403 as a switch control signal 408 through an OR circuit 413.

In the current control part 401, the attraction force command value 407 is connected to a plus input terminal of an amplifier 440 and a minus input terminal is connected to an output of a current detector 406 for detecting a current flowing through the electromagnet 301 and an output of the amplifier 440 is connected to an input of a current control element 441 such as MOSFET for controlling the current flowing through a coil 301 of the electromagnet and one end of the output is connected to one end of the electromagnet 301 and the other end of the output is connected to the power source 402, and the current control part 401 is constructed so that the attraction force command value 407 and a detection value 491 are compared by the amplifier 440.

That is, when a voltage of the attraction force command value 407 is added to an input of the amplifier 440 in the current control part 401, since the current control element 441 conducts and a current flows from the power source 402 to the electromagnet 301 and the current detector 406 detects the current and the amplifier 440 operates so as to equalize the detection value 491 (voltage value) to the attraction force command value 407, it is constructed so that a current proportional to the attraction force command value 407 flows in the current of the electromagnet 301.

The switch part 403 comprises a driving circuit 462 for inputting a signal of the switch control signal 408 and a current control element 461 capable of controlling a current of MOSFET etc. in which a gate is connected to an output of this driving circuit 462, and it is constructed so that the current control element 461 is connected in series with the electromagnet 301 and the power source 402 and the current control element 461 is turned on or off by an ON-OFF signal of the switch control signal 408.

Incidentally, diodes 404, 405 are connected between plus and minus terminals of the power source 402 and terminals of the electromagnet 301 and in the case that the command value 407 of the command generation part 400 decreases and the switch part 403 becomes OFF, when an overvoltage occurring between the terminals of the electromagnet 301 becomes higher than a voltage of the power source 402, a current flows and regenerates to the power source 402 and also the current is reduced speedily.

Figure 3:
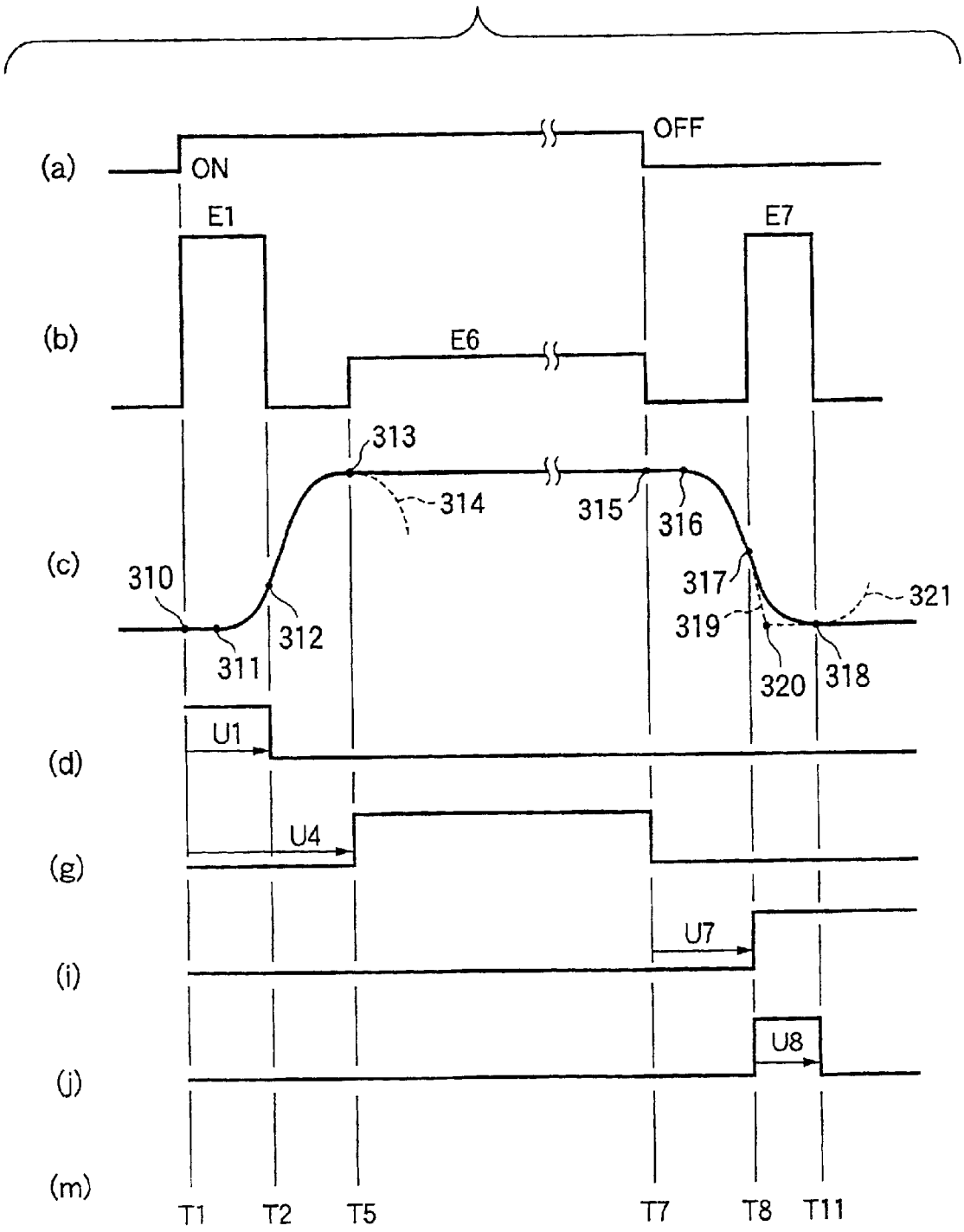
FIG. 3 is a time chart showing waveforms of each part with respect to an operation of the electromagnetic contactor by FIG. 1.

A throwing and opening operation of the electromagnetic contactor constructed as mentioned above will be described by FIGS. 1 to 3. FIG. 3 is a time chart showing operations of each part of the electromagnetic contactor and in FIG. 3, (a) shows a signal of the switch 304S and (b) shows a current waveform flowing through the electromagnet 301 and (c) shows a moving curve of a movable core 1 and (d), (g), (i), (j) show operating time of each the timer and (m) shows a time value of each point.

First, an operation in the case of throwing will be described. At time T1, when the switch 304S becomes ON, a pulse with time U1 is generated through the timer TU1 and also the switch 421 becomes ON and the command part SE1 is set to the attraction force command value 407 and the pulse with time U1 is provided to the current control part 401. The current control part 401 turns on the current control element 441 through the amplifier 440. At the same time, an output signal (high) of the timer TU7, the timer TU8 through the NOT circuit 414 is provided to the OR circuit 413 and the switch signal 408 from the OR circuit 413 is provided to the driving circuit 462 and the current control element 461 is turned on.

Therefore, a strong acceleration current E1 acting as a first current with a pulse shape flows through the electromagnet 301, and strong attraction force occurs between a movable core 1 and a fixed core 20, and the movable core 1 does not move at a point in time of numeral 310 shown in FIG. 3(*c*) and starts acceleration from a point in time of numeral 311 after a while, and a speed increases and at numeral 312 of time T2 after a lapse of time U1, the switch 421 becomes OFF and an attraction force command becomes OFF and the current control part 401 becomes OFF to break the strong acceleration current E1.

By the break, the movable core 1 approaches against repulsion of a trip spring 30 etc. in a direction of the fixed core 20 under inertia, and the speed becomes zero at a position of numeral 313 of second position time T5 which is a position reaching the fixed core 20 just.

Here, in the movable core 1, a speed Vs of numeral 312 is determined so that the speed of the position of numeral 313 which is a second position becomes zero, and in order to set electromagnetic attraction force for obtaining the speed Vs of numeral 312, a value of the strong acceleration current E1 and the time U1, namely an integral value of the strong acceleration current E1 is set. Therefore, since the integral value of the strong acceleration current E1 may be set (controlled), a waveform of the strong acceleration current E1 does not need to be a pulse shape.

After a lapse of time U4 since the switch 304S became ON, namely at numeral 313, an output of the timer TU4 becomes ON and the switch control signal 408 which is an output of the OR circuit 413 becomes ON to turn on the switch part 403, and also the switch 426 of the command generation part 400 becomes ON and when the command part SE6 is set to pass a suction current E6 acting as a second current through the electromagnet 301 via the current control part 401, the movable core 1 is already present in a position (second position) of a narrow gap with respect to the fixed core 20, so that the movable core 1 is sucked and held to the fixed core 20.

Here, since the suction current E6 maybe a holding current in which the movable core 1 maintains a state of suction to the fixed core 20 in the second position, even in case of a considerably low current compared with the strong acceleration current E1, the movable core 1 can be sucked and the suction current E6 is continuously supplied while the switch 304S has been turned on. Incidentally, unless the suction current E6 is passed through electromagnet 301, the movable core 1 moves away from the fixed core 20 as shown by numeral 314.

Therefore, after the suction current E6 is passed through the electromagnet 301 by predetermined time after turning on the switch 304S, the speed of the movable core 1 becomes substantially zero at a point in time when the movable core 1 reaches the fixed core 20, and the movable core 1 passes the suction current E6 in a position of numeral 313 to hold the movable core 1 in the second position, so that a shock in the case that the movable core 1 is thrown to the fixed core 20 can be suppressed.

Incidentally, in the embodiment, what the movable core 1 reaches the second position has been set by time of the preset timer, but the suction current E6 may be passed after detecting the second position by position detection means such as a well-known proximity switch.

Next, an operation in the case of opening the electromagnetic contactor will be described. Now, when the switch 304 is turned off at time T7, an output of the timer TU4 becomes OFF, so that the attraction force command value 407 also becomes OFF and the current control part 401 breaks the suction current E6 at the time T7. Thus, attraction force between the movable core 1 and the fixed core 20 is eliminated, but the movable core 1 does not move immediately at a point in time of numeral 315 shown in (c). From a point in time of numeral 316 after a while, the movable core 1 moves away from the fixed core 20 by repulsion of the trip spring 30 etc. to start acceleration.

After a lapse of time U7 since the switch 304S was turned off at the time T7, an output of the timer TU7 becomes ON and the timer TUB becomes ON and the switch control signal 408 which is an output of the OR circuit 413 becomes ON at numeral 317 of time T8 to turn on the switch part 403, and also the switch 427 becomes ON and the command part SE7 is set as the attraction force command value 407 and a strong deceleration current E7 acting as a deceleration current with a pulse shape flows through the electromagnet 301 at numeral 317 of time T8 via the current control part 401, and the movable core 1 is decelerated until a point in time of numeral 318 after a lapse of time U8.

Here, when the strong deceleration current E7 flows at time T8, the movable core 1 decelerates by force of a difference between attraction force by electromagnetic force and repulsion force of the trip spring 30 etc. in a direction of the fixed core 20. Thus, a speed at the time of numeral 317 gradually decreases by the force of the difference, and the time U7 at the time of numeral 317, a value of the strong deceleration current E7 and the time U8, namely an integral value of the strong acceleration current E1 are set so that the speed of the movable core 1 becomes zero at a point in time of numeral 318 of time T11 which is a second position. Therefore, since the integral value of the strong deceleration current E7 may be set (controlled), a waveform of the strong deceleration current E7 does not need to be a pulse shape.

In the movable core 1, when the strong deceleration current E7 is broken in a position of numeral 318 of time T11 which is the second position, the speed is also zero, so that a bounce is suppressed and holding is mechanically made in a first position and a release state is maintained. In the first position, the crossbar 2 moving integrally with the movable core 1 is in contact with the base 10, so that a shock between the crossbar 2 and the base 10 is also suppressed.

Here, when the time U8 for applying the strong deceleration current E7 is too long, the movable core 1 moves away from the fixed core 20 as shown by numeral 321, so that the time T11 must be accurate.

Also, unless the strong deceleration current E7 flows, further acceleration is made by repulsion of the trip spring 30 etc. as shown by numeral 319 and the crossbar 2 collides with the base 10 at a high speed in numeral 320.

Therefore, the suction current of the electromagnet 301 is broken and the strong deceleration current E7 is passed after predetermined time and the strong deceleration current E7 is broken when a speed at a point in time when the movable core 1 moves to the second position is zero and thereby, a shock in the case of release of the movable core 1 can be suppressed.

Figure 4:
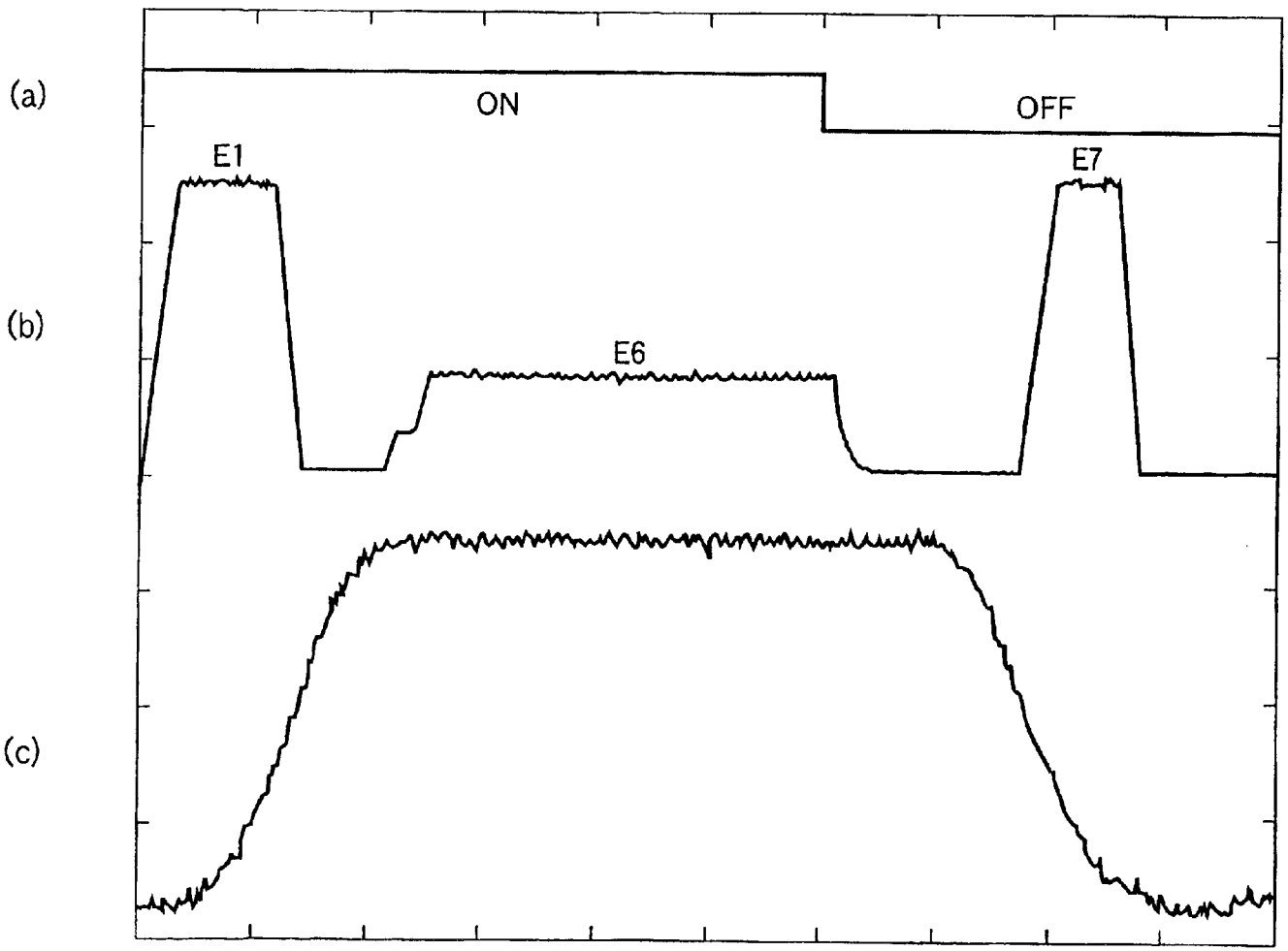
FIG. 4 is a time chart showing waveforms of each part based on experiment with respect to an operation of the electromagnetic contactor by FIG. 1.

Next, experimental data corresponding to the embodiment is shown in FIG. 4. FIG. 4 shows a time chart of each part of S-K35 type manufactured by Mitsubishi Electric Corp. and in FIG. 3, (a) shows an output signal of the switching signal part and (b) shows a current waveform flowing through the electromagnet and (c) shows a position of the movable core. As shown in the embodiment, the fact that the movable core accelerates smoothly in the case of throwing or opening the electromagnetic contactor can be seen from FIG. 3.

Second Embodiment

Figure 5:
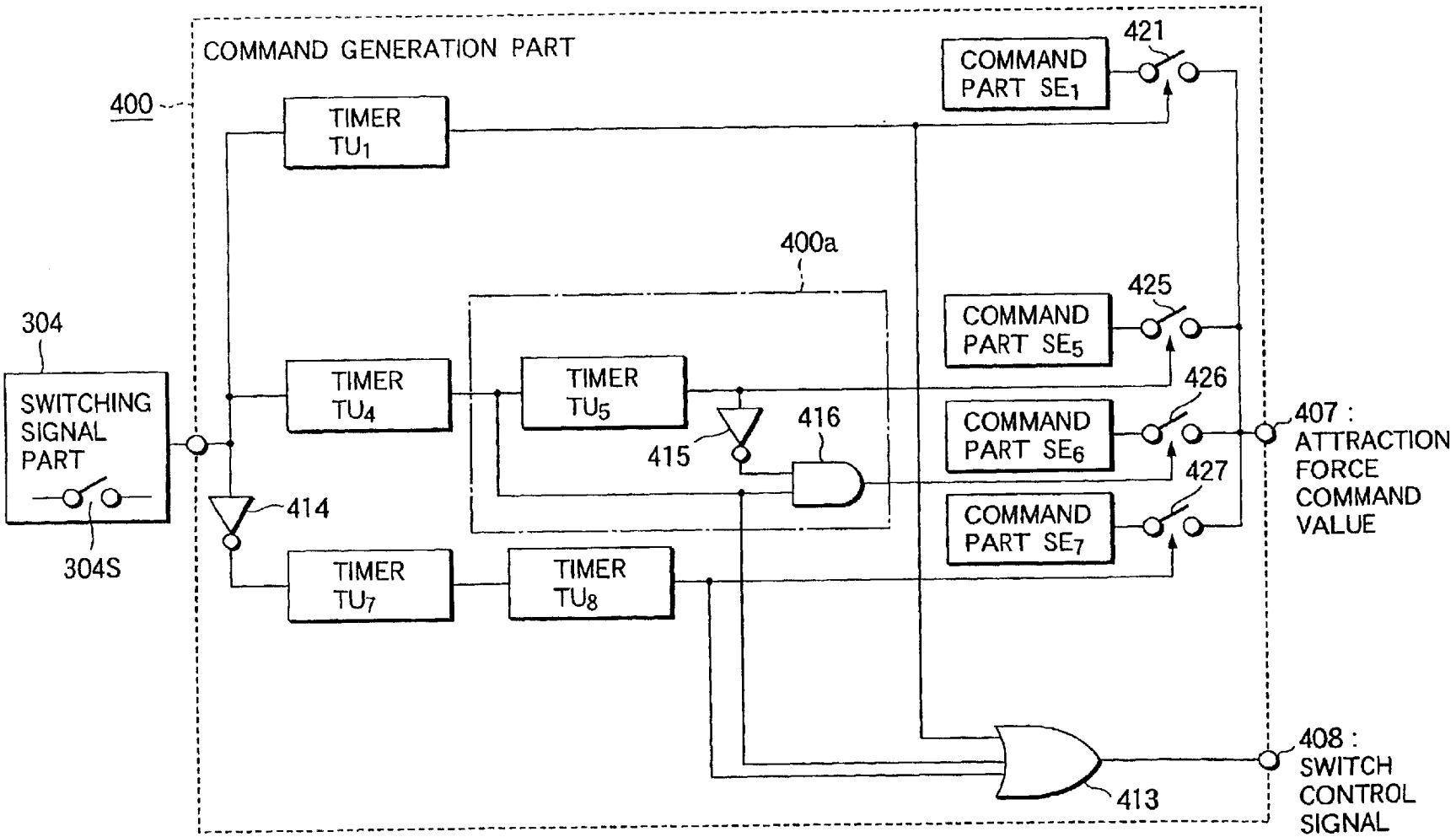
FIG. 5 is an internal circuit diagram of a command generation part showing another embodiment of this invention.

Another embodiment of this invention will be described with reference to FIGS. 1 and 5. FIG. 5 is an internal connection diagram of a command generation part shown in FIG. 1. In the embodiment, when a current passed at time T4 of FIG. 3 is in the order of a holding current, there is a possibility that suction between a movable core 1 and a fixed core 20 is not sufficient depending on variations in electromagnetic attraction force of the fixed core 20, a trip spring 30 and so on. Hence, the embodiment of the invention for improving this will be described below.

In FIG. 5, a command generation part 400 is formed by adding a second current command part 400*a* to the command generation part shown in FIG. 2, and in the second current command part 400*a*, there is a switch 425 for connecting a command value of a command part SE5 to an output based on a signal of a timer TU4, and an output signal of the timer TU4 and an output signal of a timer TU5 are inverted by a NOT circuit 415 and are ANDed by an AND circuit 416 and a switch 426 is turned on or off based on an output signal of the AND circuit 416 and a command value of a command part SE6 of an suction current E6 is outputted.

Figure 6:
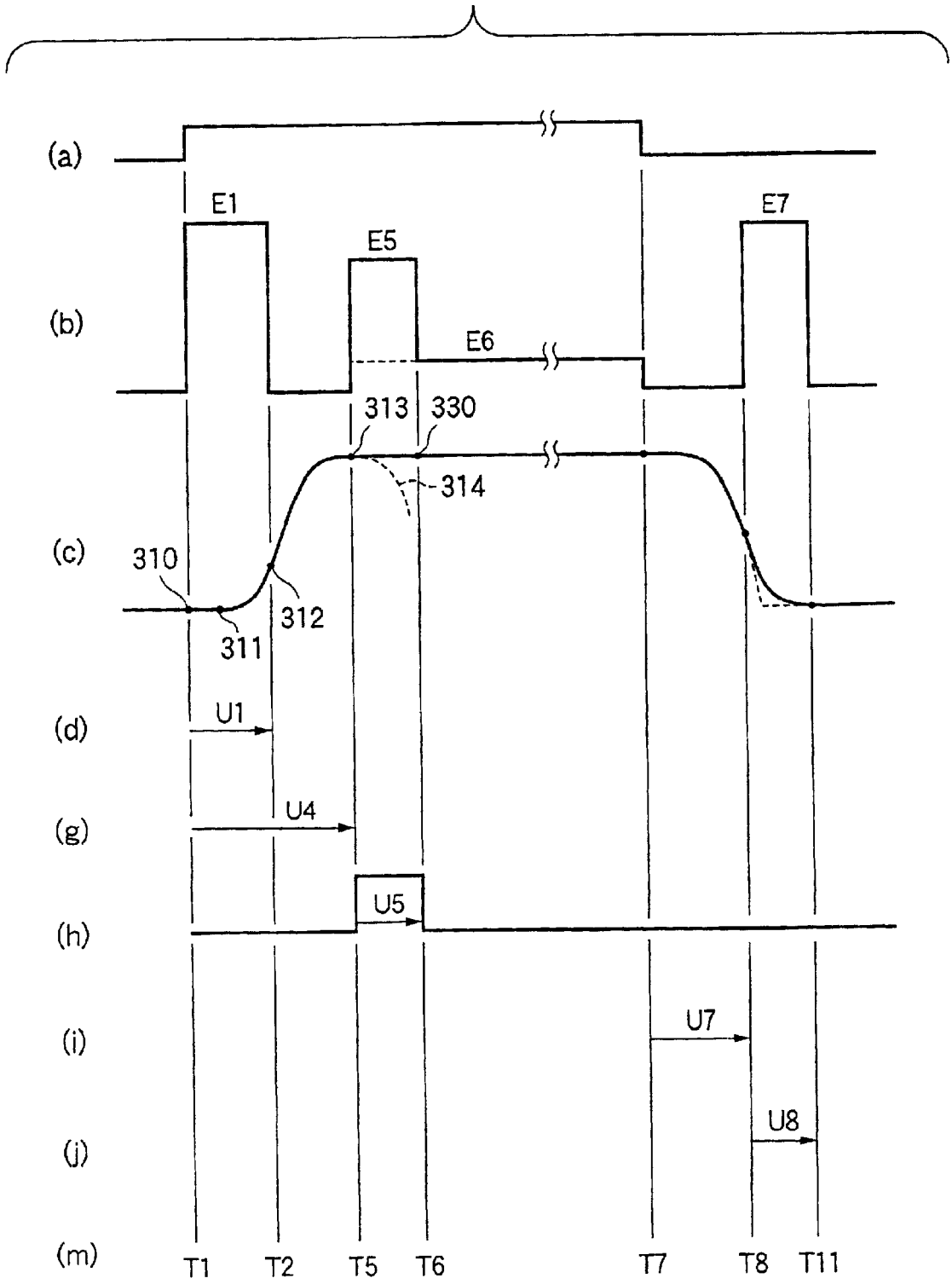
FIG. 6 is a time chart showing waveforms of each part with respect to an operation of an electromagnetic contactor by FIG. 5.

Therefore, each command value of each command part SE1, SE5, SE6, SE7 is sequentially switched by switches 421, 425, 426, 427 to output the command value to an attraction force command value 407 and a current waveform shown in FIG. 6(*b*) can be outputted.

An operation of the electromagnetic contactor constructed as mentioned above will be described by FIG. 1, FIG. 5 and FIG. 6. FIG. 6 is a time chart of each part of the electromagnetic contactor and in FIG. 6, signs of the vertical axis are identical to signs of the vertical axis of FIG. 3 except a sign (h) of the vertical axis and (h) is an output signal of a timer U5. Since an operation from time T5 to time T7 differ from that of the first embodiment, only a different portion will be described.

At numeral 313, an output of the timer TU4 becomes ON and a switch control signal 408 which is an output of an OR circuit 413 becomes ON to turn on a switch part 403, and also the timer TU5 becomes ON and the switch 425 becomes ON and the attraction force command value 407 of the command part SE5 is provided to a current control part 401 and a strong suction current E5 higher than a holding current value acting as a second current is passed through an electromagnet 301 for a time U5 and the movable core 1 which is insubstantially a second position is surely attracted.

At time T6 which is a point in time of numeral 330 in which the time U5 is completed, the timer TU5 becomes OFF and this signal is inverted by the NOT circuit 415 and is provided to one input of the AND circuit 416 and the output of the timer TU4 is kept in an ON state in the other input, so that an output of the AND circuit 416 becomes ON and the switch 425 is turned on and in a manner similar to the first embodiment, a suction current E6 is passed through the electromagnet. Here, since a value of the strong suction current E5 and a value of the time U5 passing this current may be a value for attracting the movable core 1 to become stable, a considerably wide range is permitted.

Therefore, after a switch 304S is turned on, a strong acceleration current is passed through the electromagnet 301 for a predetermined time and at a point in time when the movable core 1 reaches the fixed core 20, the strong suction current E5 is passed for a predetermined time and then the suction current E6 is passed and thereby, the suction of the movable core 1 can be ensured while suppressing a shock in the case of throwing the movable core 1.

Third Embodiment

Figure 7:
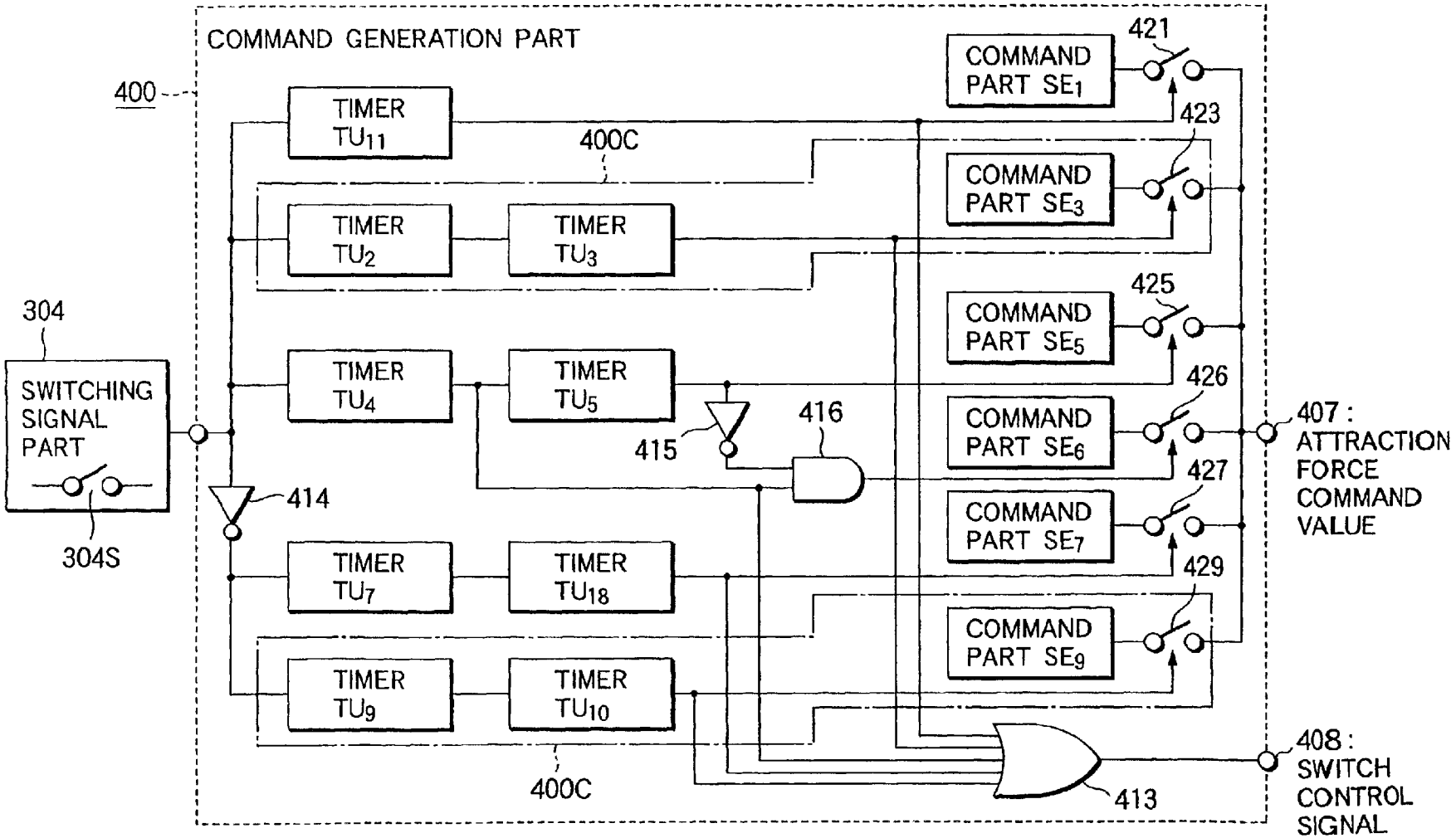
FIG. 7 is an internal circuit diagram of a command generation part showing the other embodiment of this invention.

The other embodiment of this invention will be described with reference to FIGS. 1 and 7. FIG. 7 is an internal connection diagram of a command generation part. In the first and second embodiments, since a speed before a movable core 1 is moved to a first or second position is high, it is considered that a shock occurs in the case of throwing or opening an electromagnetic contactor depending on variations in a voltage change and so on.

Hence, in order to eliminate the above, the embodiment of this invention reduces the final acceleration in the case of throwing or releasing the movable core 1. In FIG. 7, in a command generation part 400, the timer TU1 of the command generation part shown in FIG. 5 is changed to a timer TU11 having time U11 slightly shorter than setting time U1 of the timer TU1 and is changed to a timer TU18 having time U18 slightly shorter than setting time of the timer TU8 and a current command part 400*c* of a weak acceleration current E3, a current command part 400*e* of a weak deceleration current E7, outputs of a timer TU3 and a timer TU10 are connected to an input of an OR circuit 413.

The current command part 400*c* comprises a timer TU2 for generating a lag signal of time U2 of a weak acceleration current E3 by an ON signal of a switch 304S and a timer TU3 for generating a pulse of time U3 based on a signal of the timer TU2. The current command part 400*e* comprises a timer TU9 for inverting an OFF signal of the switch 304 by a NOT circuit 414 to generate a lag signal U9 of a weak deceleration current E9 and a timer TU10 for generating a pulse of time U10 based on a signal of the timer TU9, and it is constructed so that command values of command parts SE3, SE9 are outputted to a current control part 401 as an attraction force command value 407 by switches 423, 429 for connecting the command value to an output based on the timers TU3, TU10.

Figure 8:
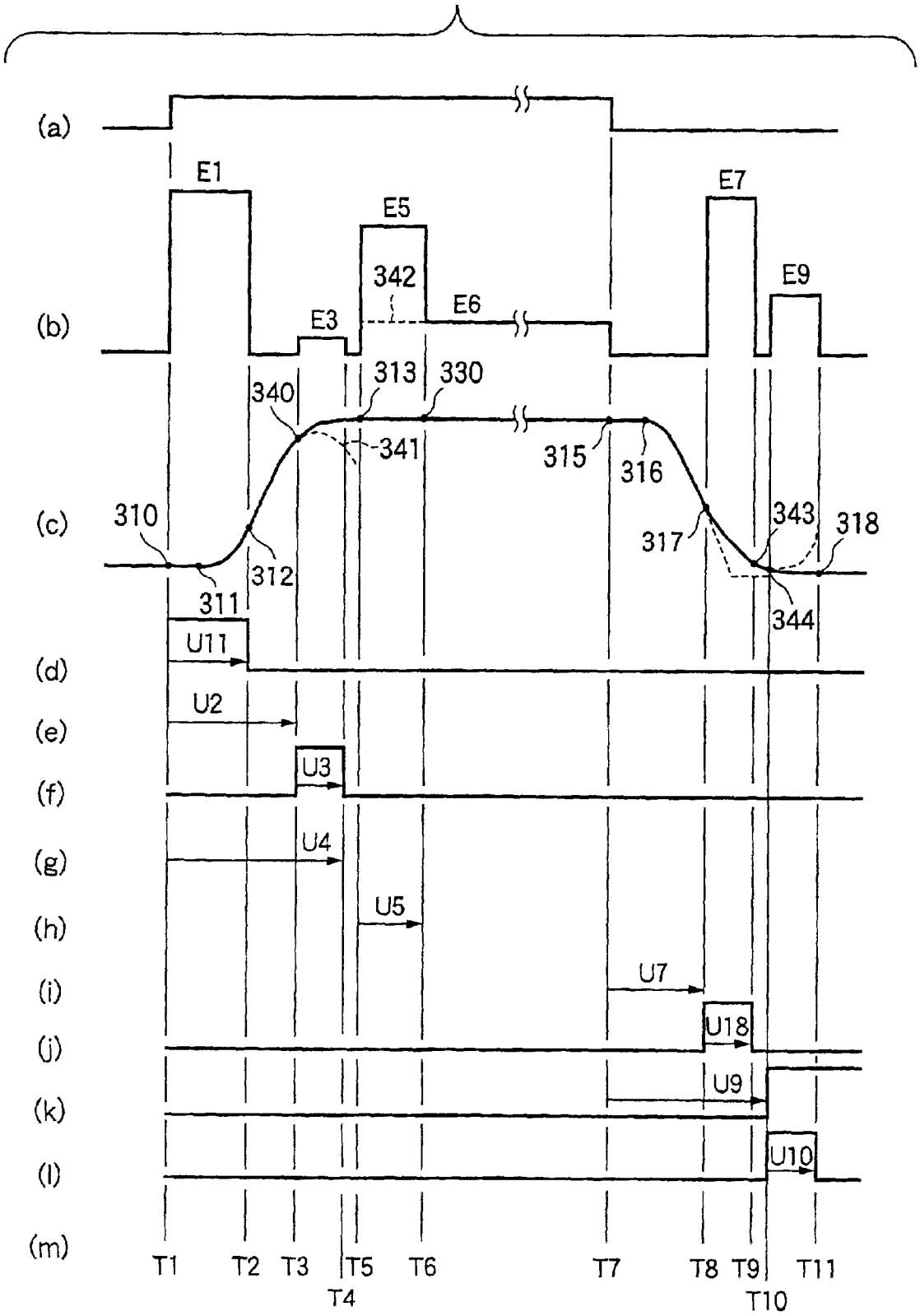
FIG. 8 is a time chart showing waveforms of each part with respect to an operation of an electromagnetic contactor by FIG. 7.

An operation of the electromagnetic contactor constructed as mentioned above will be described by FIG. 1, FIG. 7 and FIG. 8. FIG. 8 is a waveform chart and a time chart for illustrating an operation of each part of the electromagnetic contactor and in FIG. 8, like signs of the vertical axis are like or corresponding portions of FIG. 6 and (f) is an output signal of the timer TU3 and (k) is an output signal of the timer TU9 and (1) is an output signal of the timer TU10.

First, an operation in the case of throwing will be described. Since an operation to time T2 is substantially similar to that of the embodiment described above except that time U11 of a strong acceleration current E1 flowing through an electromagnet 301 is slightly shorter than time U1, a description is omitted. Here, the reason why the time U11 for which the strong acceleration current E1 flows is slightly shortened is because acceleration is set so that the movable core 1 does not reach a second position and becomes a speed for stopping in the slightly front of the second position as shown by numeral 341 and acceleration at the time of holding the movable core 1 is decreased.

However, in case of being left, the movable core 1 stops in the slightly front of the second position and moves toward a first position by a trip spring 30 etc., so that at time T3, acceleration is made at a low speed by a distance in which the movable core 1 does not reach the second position by passing a weak acceleration current E3 acting as a second current lower than a strong acceleration current E1 (first current) for a time U3 in a position 340 of time T3 at which the movable core 1 approaches a fixed core 20. Thus, strength of the weak acceleration current E3 and the time U2, U3 are determined so that a speed becomes zero in a position 313 of time T5 which is a position in which the movable core 1 reaches the fixed core 20.

Therefore, in the case of throwing the movable core 1, the strong acceleration current E1 is passed through the electromagnet 301 by a predetermined time U11 and when the movable core 1 reaches a distance close to the fixed core 20, the weak acceleration current E3 is passed by a predetermined time U3 and at a point in time when the movable core 1 reaches the fixed core 20, a strong suction current E5 or a suction current E6 is passed and thereby, the suction of the movable core 1 can be ensured while suppressing a shock in the case of the throwing.

Next, an operation in the case of opening the electromagnetic contactor will be described by FIG. 1, FIG. 7 and FIG. 8. Since an operation to time T2 is substantially similar to that of the embodiment described above except that time U18 of a strong deceleration current E7 acting as a first deceleration current flowing through an electromagnet 301 is slightly shorter than time U8, a description is omitted. Here, the reason why the time U18 for which the strong deceleration current E7 flows is slightly shortened is because deceleration is set so that the movable core 1 does not reach a first position and becomes a speed for stopping in the slightly front of the first position as shown by numeral 343 and deceleration in the proximity of the first position of the movable core 1 is decreased.

However, in case of being left, the movable core 1 moves at rapid deceleration from the slightly front of the first position toward the first position by a trip spring 30 etc., so that a weak acceleration current E9 acting as a second deceleration current is passed for a time U10 in a position 344 of time T10 at which the movable core 1 approaches the fixed core 20 and thereby, the movable core 1 becoming slow at a point in time of numeral 343 is decelerated further slowly, namely deceleration is made at a low speed by a distance in which the movable core 1 does not reach the first position and when the weak deceleration current E9 is broken in a position 318 of time T1 which is the first position, a crossbar 2 is in contact with a base 10, so that a shock is suppressed.

Here, a value of the weak deceleration current E9 and values of the time U9, U1 are determined so that a speed becomes zero in the position 318 of the time T11. Incidentally, since a speed of the movable core 1 has become slow at the time T11, a shock speed of the movable core 1 can be released in a low state even in the case of some deviation backward and forward.

Therefore, the suction current E6 of the electromagnet 301 is broken and the strong deceleration current E7 is passed by time U18 after a predetermined time U7 and the weak deceleration current E9 is passed when the movable core 1 approaches the first position and the weak deceleration current E9 is broken when the movable core 1 reaches the first position and thereby, a shock in the case of release can be suppressed.

Incidentally, the current flowing through the electromagnet 301 shown in the first to third embodiments is shown by a rectangular wave, but the current may be a curve or intermittence. Also, the current flowing through the electromagnet 301 is shown by a rectangular shape since a coil 21 has an inductance, but actually, the current has a slope determined by a voltage applied with an increase or decrease in the current and becomes a trapezoidal waveform.

Fourth Embodiment

Figure 9:
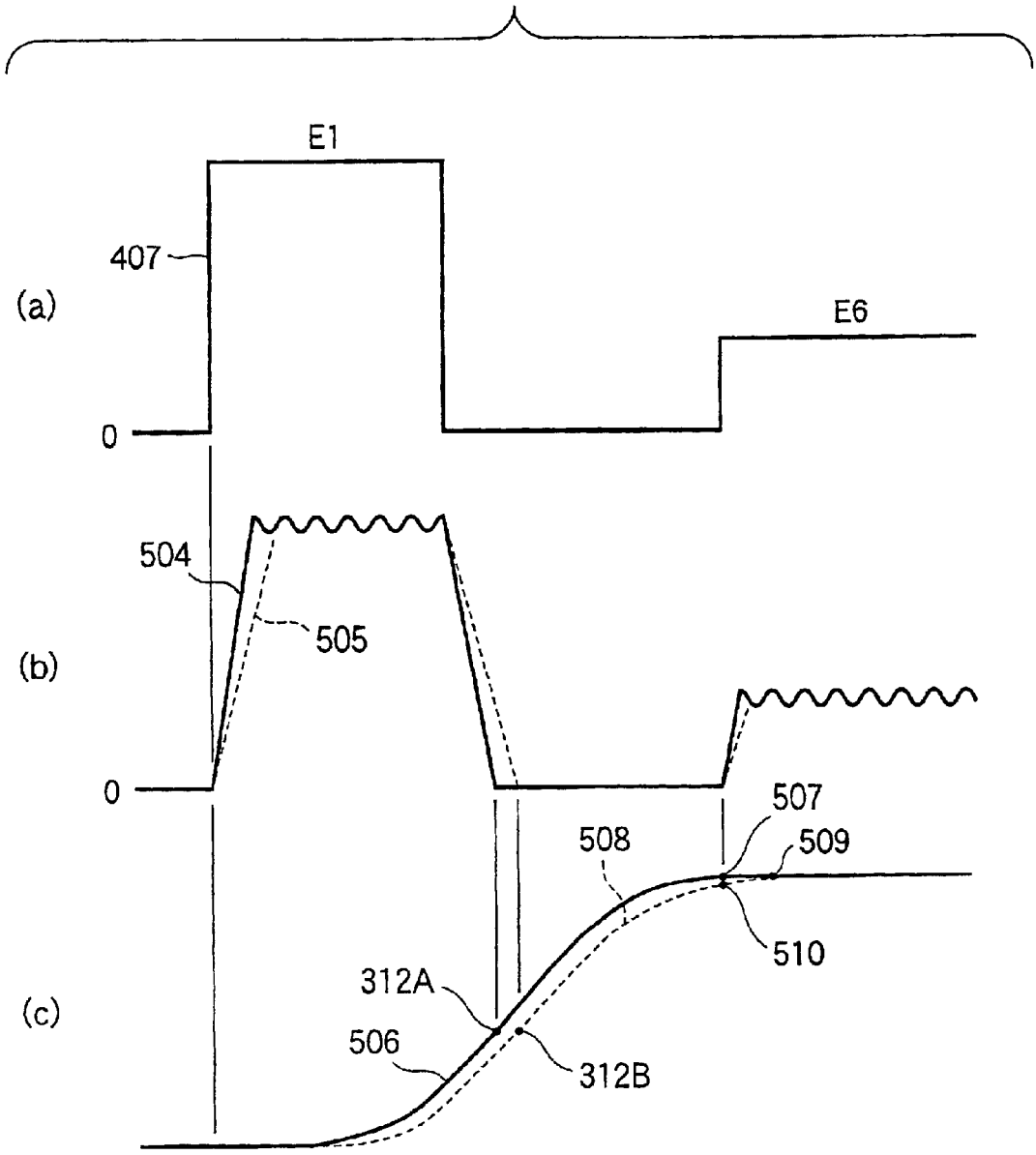
FIG. 9 is a time chart of each part in the case of a change in a power voltage.

In the first to third embodiments, since an attraction force command value 407 of a command generation part 400 is a pulse shape as shown in FIG. 9(*a*), a rise curve of a current 504 flowing through an electromagnet 301 shown in (b) depends on a voltage of a power source 402 because of an inductance of a coil and for example, when the voltage of the power source 402 decreases, a rate of change in rise or fall reduces as shown by a dotted line 505.

Here, as shown by a dotted line of (b), when a power source voltage decreases, the current flowing through the electromagnet 301 becomes a state as shown by the dotted line 505 from a solid line 504 and as shown in (c), a movable core 1 becomes movement shown by a dotted line 508 and is accelerated to numeral 312B. When the power source voltage is high, acceleration is made only to numeral 312A, so that the peak deviates from numeral 507 to numeral 509. Thus, in the case that the voltage decreases, when a suction current E6 is passed at a point in time of a position 510 of the movable core 1, the movable core 1 does not reach a second position yet, so that a collision speed of the movable core 1 does not become zero and a shock occurs. On the other hand, in the case that the voltage increases, when the suction current E6 is passed at a point in time of the position 510 of the movable core 1, the movable core 1 reaches the second position and then moves toward a first position, so that the collision speed does not become zero and a shock occurs.

Figure 10:
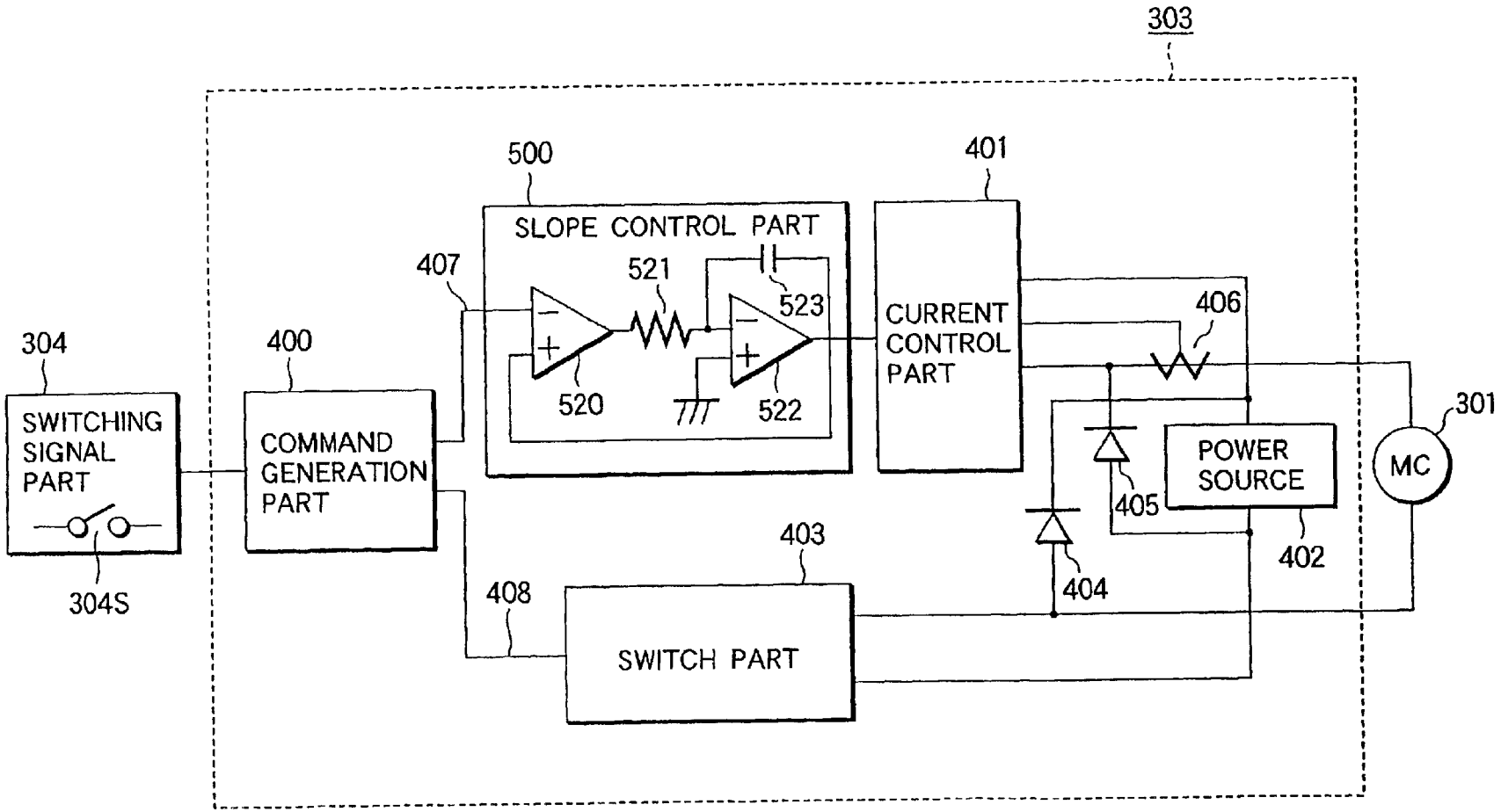
FIG. 10 is an internal circuit diagram for limiting a slope of a command signal of a command generation part according to the other embodiment of this invention.
Figure 11:
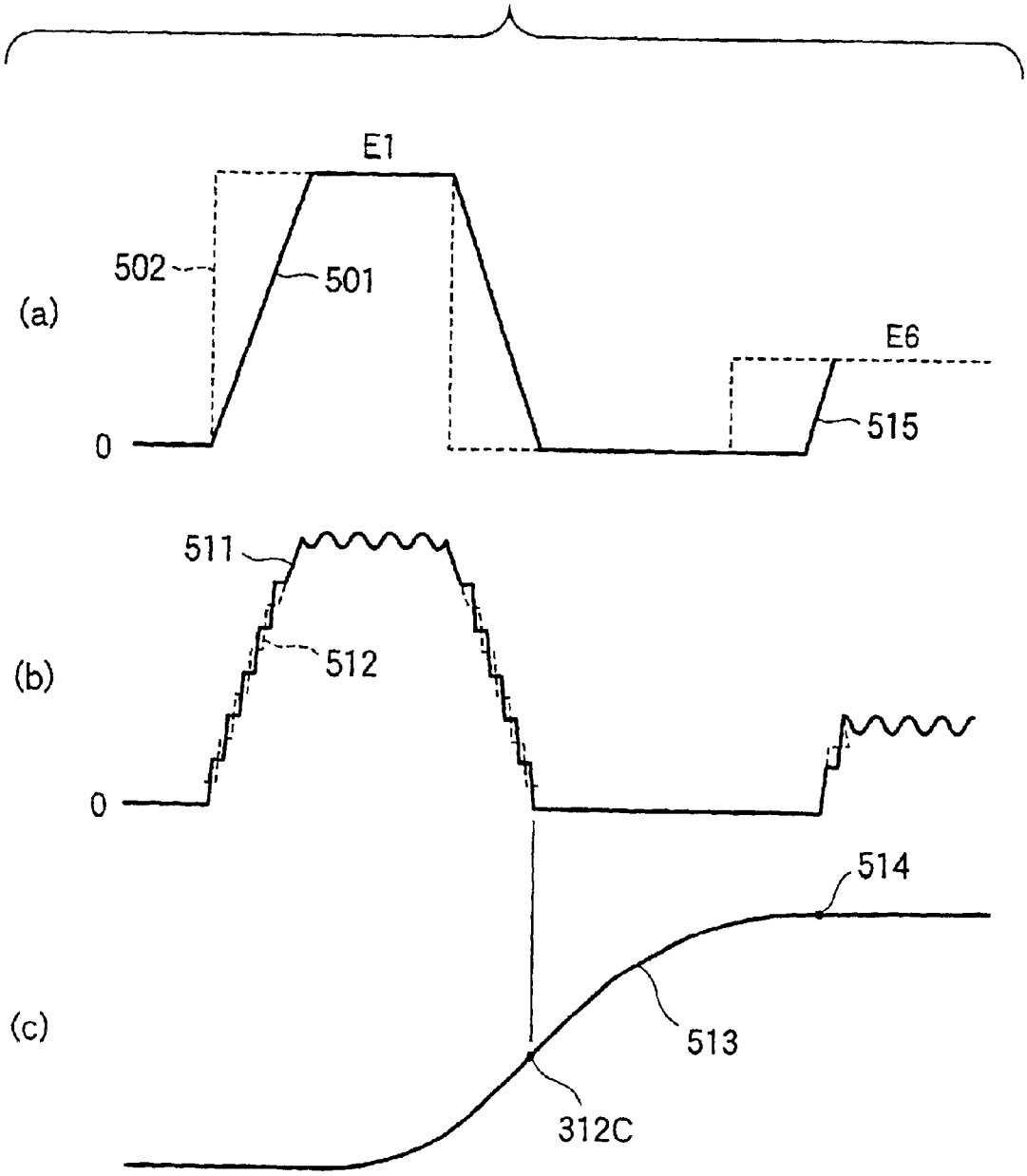
FIG. 11 is a time chart showing waveforms of each part with respect to an operation of an electromagnetic contactor by FIG. 10.

The other embodiment of this invention obtains an electromagnetic contactor in which an operation is stable with respect to variations in temperature or power source voltage and a shock in the case of throwing or opening is suppressed. The other embodiment of this invention will be described by FIGS. 10 and 11. FIG. 10 is a block diagram showing an attraction force control part 303, and FIG. 11 is a time chart showing an operation of each part of the electromagnetic contactor.

In FIG. 10, the attraction force control part 303 is provided with a slope limit part 500 between a command generation part 400 and a current control part 401. The slope limit part 500 makes a conversion into a command value 501 in which an attraction force command value 407 has a constant rate of change or less, namely a predetermined slope in a rise and a fall of a current, and controls a current of an electromagnet 301 based on this command value 501.

In the slope limit part 500, an integrator is formed by connecting the attraction force command value 407 to a minus input of an amplifier 520 and connecting an output of the amplifier 520 to a minus input of an amplifier 522 through a resistor 521 and connecting a capacitor 523 to input and output terminals of the amplifier 522 and connecting an output of the amplifier 522 to a plus input of the amplifier 520. Using the fact that a value in which a rate of change in voltage of this integrator is determined by the resistor 521 and the capacitor 523 becomes constant, a rate of change in the attraction force command value 407 is converted into a constant value or less and the command value 501 is obtained. Thus, in the slope limit part 500, the command value 501 outputs the same value when the attraction force command value 407 changes slowly, but a rate of change in the command value 501 smooths when the attraction force command value 407 changes quickly.

An operation of the electromagnetic contactor constructed as mentioned above will be described by FIGS. 10 and 11. (c) shows movement of the movable core 1 and becomes the movement shown by numeral 513 and is accelerated to point 312C. Therefore, when a suction current E6 is passed on attaining the peak at numeral 514, suction can be performed at a collision speed of zero.

The slope limit part 500 has a command value 501 as shown in FIG. 11(*a*), and a slope of the command value 501 is set lower than a slope 505 of a current shown in FIG. 9(*b*). When the current control part 401 operates with respect to this command value 501, a change in a current flowing through an electromagnet becomes numeral 511 for a high voltage and becomes numeral 512 shown by a dotted line for a low voltage as shown in FIG. 11(*b*). Since a change in the current flowing through the electromagnet 301 is made along the command value 501 of the slope limit part 500, it is little related to a change in voltage.

Therefore, as shown in FIG. 11(*c*), since an accelerated speed and a position in point 312C in which an acceleration current E1 of a moving curve 513 of the movable core 1 is broken are resistant to vary by the change in voltage, a position 514 of the movable core 1 does not vary. Thus, at the same timing of the suction current E6, the movable core 1 can be attracted in a position 515 of a collision speed of zero.

Since a conversion into the command value 501 in which an attraction force command value 407 of the command generation part 400 becomes a constant rate of change or less by the slope limit part 500 is made, the current control part 401 controls a current of the electromagnet 301 based on the command value 501. Thus, even when the power source voltage varies, a shock speed in the case of throwing or releasing of the movable core 1 can be suppressed.

Incidentally, even when a temperature of the electromagnet 301 increases and a resistance value of a coil changes and a rate of change in current changes, a stable operation is performed in a manner similar to variations in the power source voltage. Also, the slope limit part 500 may make a conversion into a command value 501 having a predetermined slope in a rise or a fall of the attraction force command value 407.

Fifth Embodiment

Figure 12:
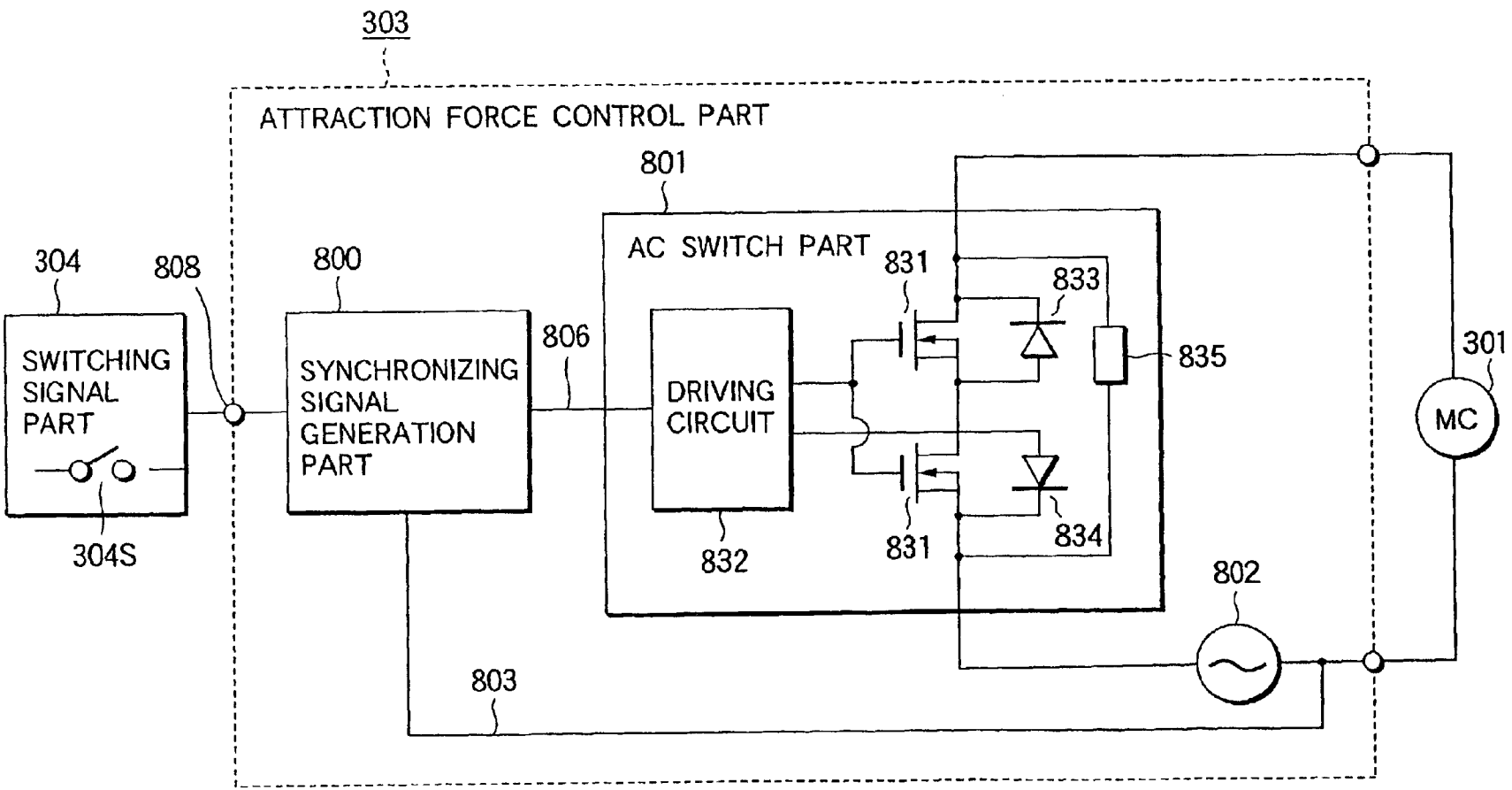
FIG. 12 is the entire block diagram of an electric portion of an AC drive type electromagnetic contactor showing the other embodiment of this invention.
Figure 13:
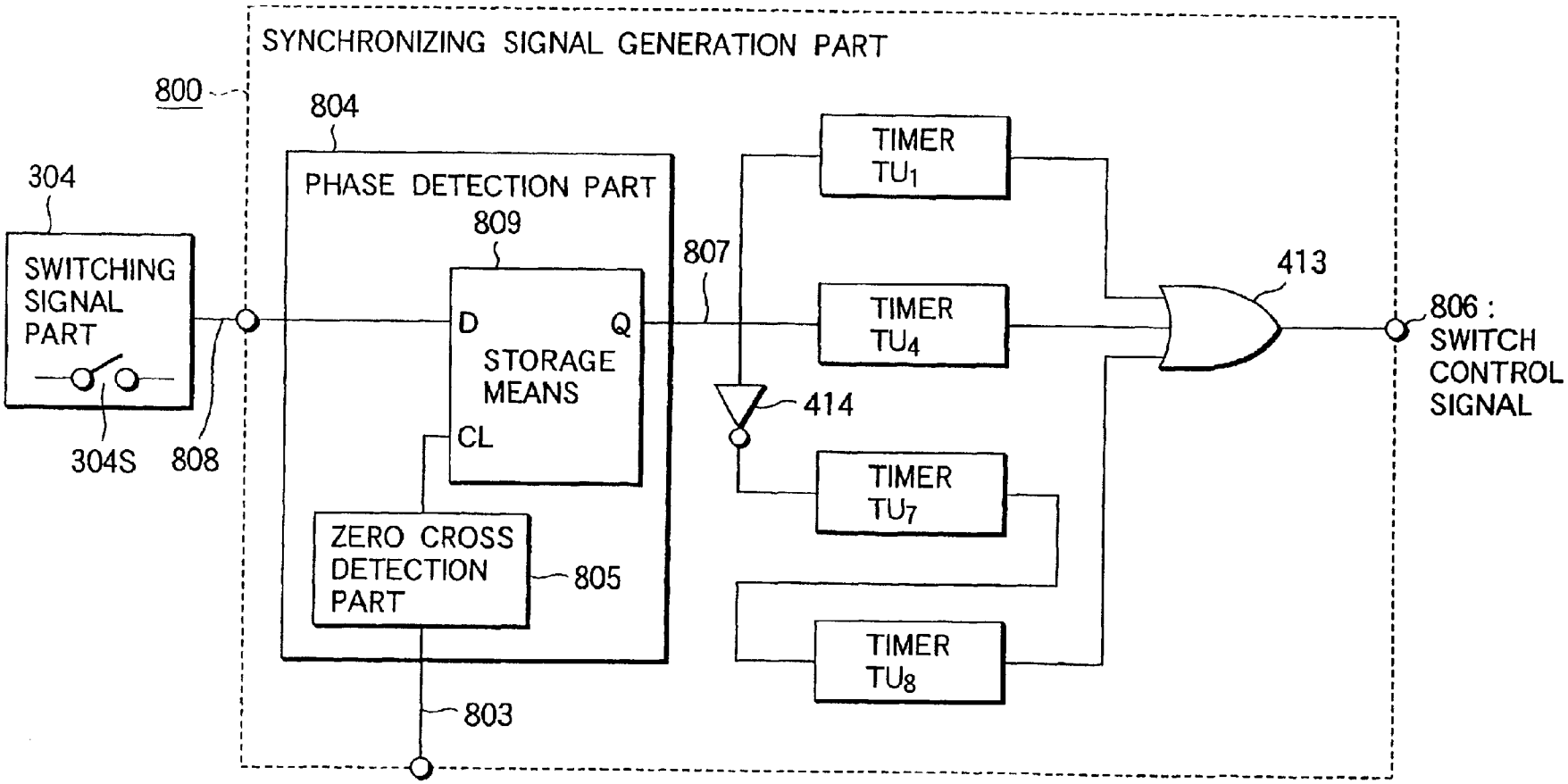
FIG. 13 is an internal circuit of a synchronizing signal generation part shown in FIG. 12.

The other embodiment of this invention will be described by FIGS. 12 and 13. FIG. 12 is a block diagram of an electric portion of an electromagnetic contactor of AC excitation, and FIG. 13 is an internal circuit of a synchronizing signal generation part. In the embodiment of this invention, the first embodiment is applied to an AC drive type electromagnetic contactor and in FIGS. 12 and 13, an attraction force control part 303 acting as phase control means for controlling a voltage phase applied to an electromagnet 301 based on a switch 304 acting as opening signal means which is a signal for opening and closing an electromagnetic contactor 100 comprises a synchronizing signal generation part 800, an AC switch part 801 and an AC power source 802.

The synchronizing signal generation part 800 comprises a phase detection part 804 and a timer part, and in the phase detection part 804, an on-off signal 808 of the switch 304S is connected to a data input terminal of a D-type flip-flop 809 and a voltage 803 of the AC power source 802 is inputted to a clock terminal CL of the flip-flop 809 through a zero cross detection part 805 for outputting a pulse signal at a zero cross point and a phase synchronizing signal 807 of the D-type flip-flop 809 is outputted.

The timer part comprises a timer TU1 for generating a pulse with time U1, a timer TU4 for generating a signal U4, a timer TU7 for generating a signal U7 based on a signal in which a synchronizing switch signal 807 is inverted by a NOT circuit 414, a timer TU8 for generating a pulse with time U8 based on a signal of the timer TU7 and an OR circuit 413 for ORing output signals of the timers TU1, TU4, TU8, and it is constructed so that an output of the OR circuit 413 is outputted to the AC switch part 801 as a switch control signal 806.

In the AC switch part 801, two switching elements 831 are connected in series in the reverse direction, and diodes 833, 834 are connected between outputs of the switching elements 831, and the switching elements 831 are turned on or off by the switch control signal 806 through a driving circuit 832. Incidentally, a varistor 835 acting as a high voltage absorption element is connected between outputs of the AC switch part 801.

Figure 14:
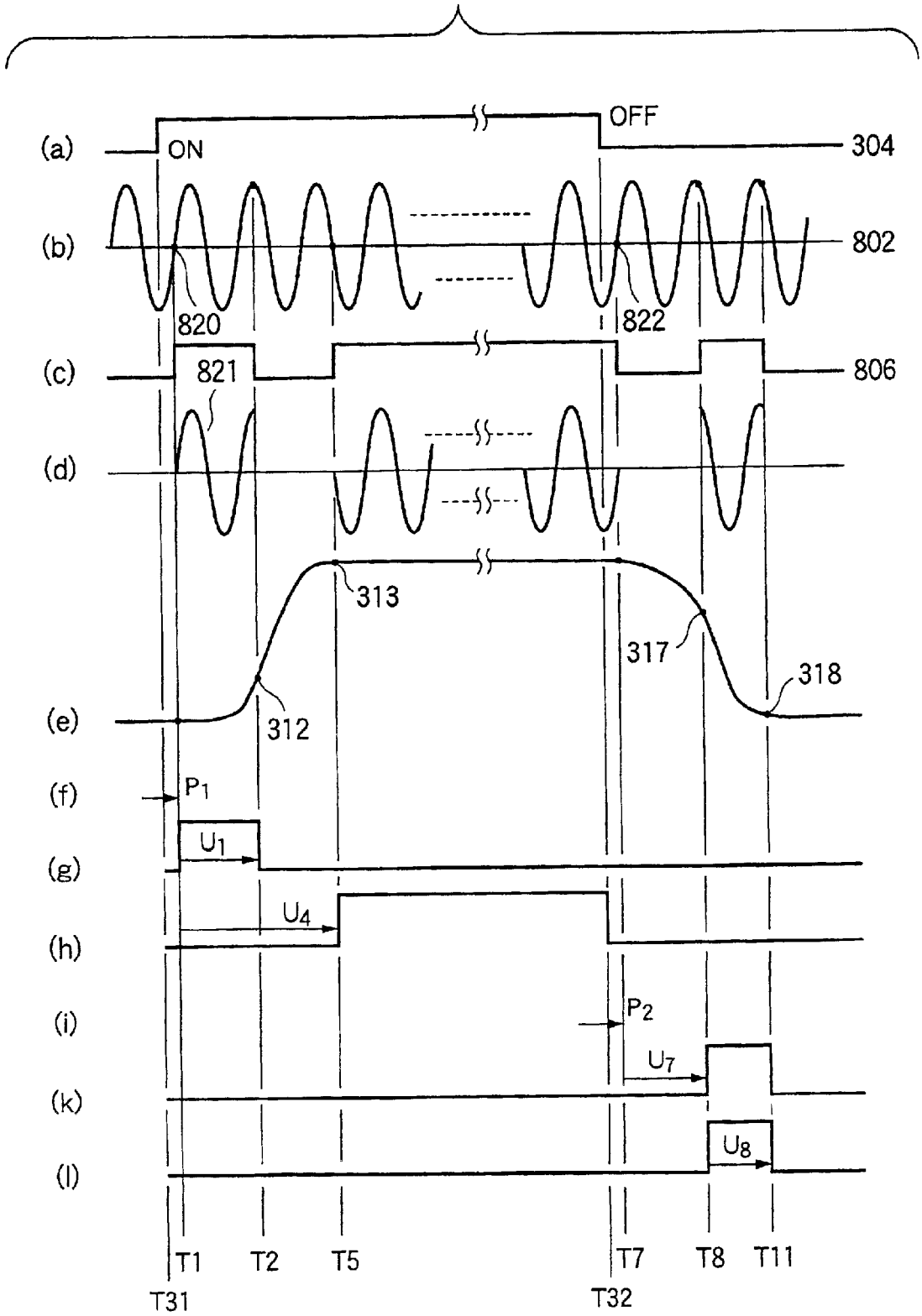
FIG. 14 is a time chart showing waveforms of each part with respect to an operation of an electromagnetic contactor by FIG. 12.

An operation of the electromagnetic contactor constructed as mentioned above will be described by FIGS. 12 to 14. FIG. 14 is a time chart showing operations of each part of the electromagnetic contactor and in FIG. 14, (a) shows a signal of the switch 304S and (b) shows a voltage waveform of an AC power source and (c) shows an output signal 806 of the synchronizing signal generation part 800 and (d) shows an applied voltage waveform of an electromagnet 301 and (e) shows movement of a movable core 1 and (g), (h), (k), (l) show operating waveforms of timers and (f), (i) show lag time from an on-off signal of the switch 304S.

Now, when the switch 304S becomes ON at time T31, a voltage of the AC power source 802 becomes a zero cross point at time T1 after a lapse of time P1 and an output signal from the zero cross detection part 805 becomes ON, and a pulse with time U1 is generated from the timer TU1 and the switching elements 831 are turned on for the time U1 through the OR circuit 413 and the driving circuit 832, and a voltage waveform of numeral 821 of FIG. 14(*d*) is applied to the electromagnet 301 and a current flows. Thus, strong attraction force occurs between a movable core 1 and a fixed core 20 and the movable core 1 accelerates and moves to a position 312 of time T2 and the AC switch part 801 is turned off at the time T1.

A speed of this position 312 is defined by the time U1 which is ON time of an AC voltage and the AC switch part 801, and is determined so that a speed becomes zero at a second position of numeral 313 of the movable core 1, namely at time T5. Also, since the AC switch part 801 has been turned on from a zero cross point 820, a constant AC voltage is applied to the electromagnet 301 irrespective of timing in which the switch 304S is turned on.

Next, since the AC switch part 801 is turned off, the movable core 1 approaches against repulsion of a trip spring 30 etc. in a direction of the fixed core 20 under inertia and a speed becomes slow gradually by the repulsion and since an output of the timer TU4 becomes a high signal at time T5 of a position 313 of the movable core 1 after time U4 from the time T1, when the AC switch part 801 is turned on, the movable core 1 has moved to the second position, so that the movable core 1 is sucked to the fixed core 20 and the suction state is held while the switch 304S has been turned on.

Next, an operation in the case of opening the electromagnetic contactor will be described. Now, when the switch 304S becomes OFF at time T32, the phase detection part 804 detects that a voltage of the AC power source 802 became a zero cross point 822 at time T7 after time P2 of an AC voltage and the AC switch part 801 is turned off.

After a lapse of time U7 from the zero cross point 822, an output of the timer TU7 becomes a high signal and at time TB which is a position 317 of the movable core 1, a pulse with time U8 is generated from the timer TUB and the AC switch part 801 is turned on for the time U8, and the movable core 1 approaches a first position while decelerating by force of a difference between attraction force by electromagnetic force and repulsion force of the trip spring 30 etc. in a direction of the fixed core 20, and a speed at the time of numeral 317 gradually decreases by the force of the difference, and a speed of the movable core 1 decelerates and becomes zero at time T11 which is a position of numeral 318.

That is, the time U7 at the time of numeral 317 and the ON time U8 of the AC switch part 801 are determined so that the speed becomes zero at the position of numeral 318. Deceleration from numeral 317 to numeral 318 of the movable core 1 is determined by the ON time U8 and an AC voltage.

After an opening signal of the electromagnetic contactor 100 is generated by the switch 304S and then an AC voltage of the AC power source 802 becomes a zero cross point, a voltage applied to the electromagnet 301 by the AC switch part 801 is broken and after a predetermined time U7, a voltage is applied to the electromagnet 301 for a predetermined time U8 by the AC switch part 801 and then the applied voltage to the electromagnet 301 is broken in a first position 318 of the movable core 1 by the AC switch part 801, so that a shock in the case of opening the electromagnetic contactor can be suppressed even for the AC power source since the crossbar 2 is in contact with the base 10 in the first position. In addition, since the voltage applied to the electromagnet 301 is broken at the zero cross point which is a predetermined phase and the voltage is applied to the electromagnet 301 for the time U8 after the time U7, an integral value of the voltage applied to the electromagnet 301 becomes constant, so that the movable core 1 can be moved to the first position accurately regardless of a phase of the AC voltage.

Sixth Embodiment

Figure 15:
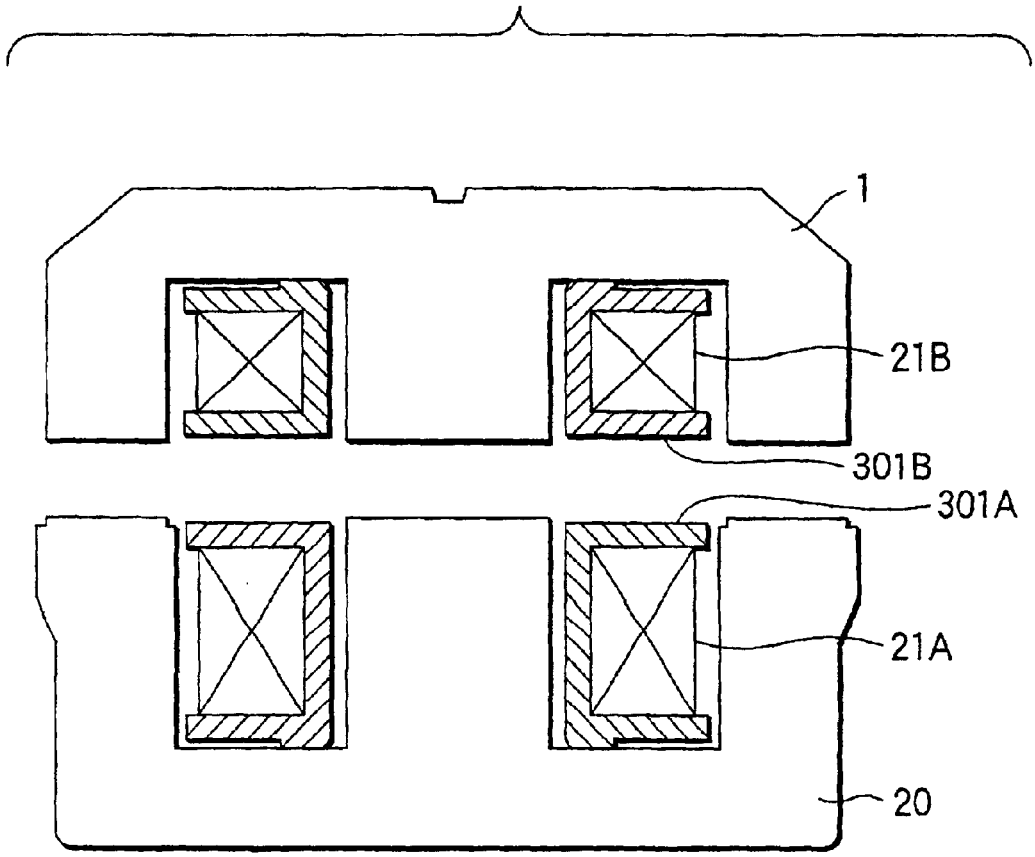
FIG. 15 is a front view providing an electromagnet for a movable core and a fixed core of an electromagnetic contactor in the other embodiment of this invention.

The other embodiment of this invention will be described by FIGS. 15 to 17. FIG. 15 is a front view of a first electromagnet for exciting a fixed core and a second electromagnet for exciting a movable core 1 and FIGS. 16 and 17 are circuit diagrams of an electric portion.

In the embodiment of this invention, an electromagnetic contactor for shortening throwing or opening time while suppressing a shock in the case of throwing or opening will be described.

In FIG. 15, in the electromagnetic contactor, a fixed core 20 having an electromagnet 301A in which a coil 21A is wound on a bobbin and a movable core 1 having an electromagnet 301B in which a coil 21B is wound on a bobbin in the same direction as the coil 21A are formed, and when a current of the same direction is passed through the coil 21A and the coil 21B, the fixed core 20 and the movable core 1 are magnetized and attraction force acts and both of the cores suck. On the other hand, when a current of the coil 21A or the coil 21B is passed in the reverse direction, it is constructed so that they are magnetized in a repulsion direction and the fixed core 20 and the movable core 1 move away.

Figure 16:
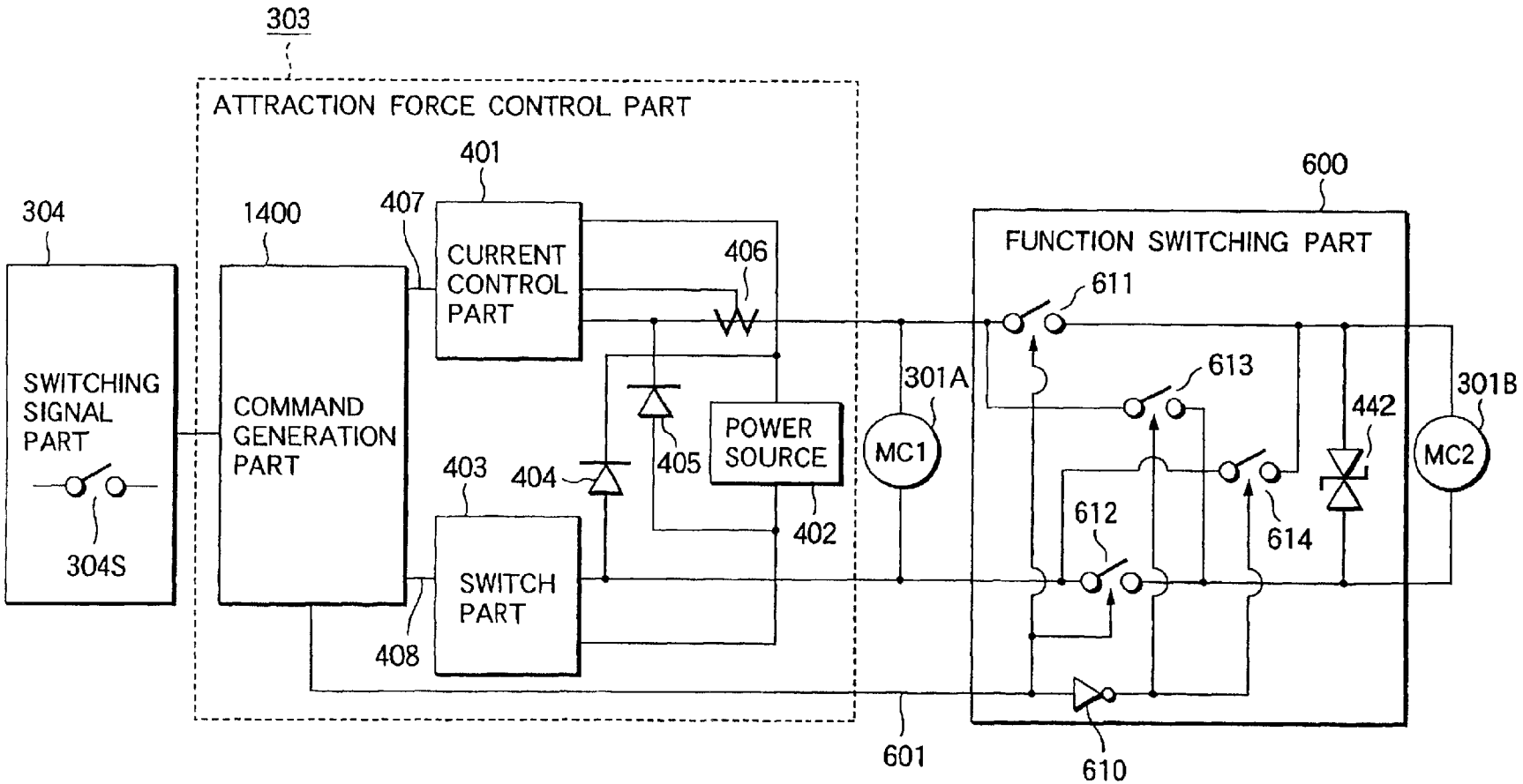
FIG. 16 is a block diagram showing an electric portion of an electromagnetic contactor by FIG. 15.
Figure 17:
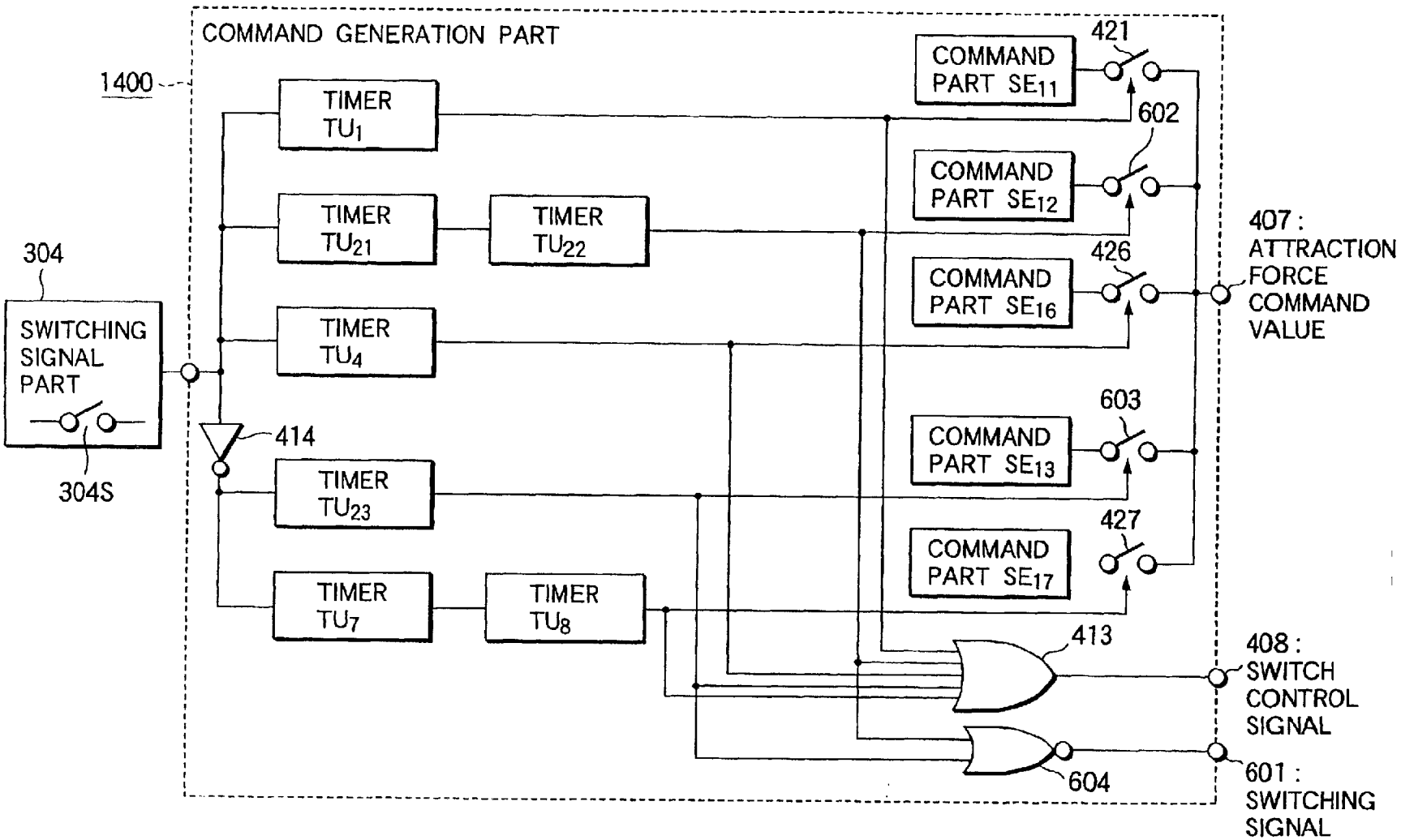
FIG. 17 is an internal circuit diagram of a command generation part shown in FIG. 16.

In FIG. 16, the same signs as the FIG. 1 show the same or corresponding portions and a description is omitted. In FIG. 16, it is constructed so that the electromagnet 301A and a switching part 600 acting as switching means are connected to an output of an attraction force control part 303 and the electromagnet 301B is connected to an output of the switching part 600 and a direction of a current flowing through the electromagnet 301B is switched by the switching part 600.

A command generation part 1400 comprises a timer TU1 for generating a pulse for passing attraction currents E21, E31 for time U1 by an ON (closing) signal of a switch 304S, a timer TU21 for generating a lag signal U21 at a start point in time when repulsion currents E22, E32 flow by ON of the switch 304S, a timer TU22 for generating a pulse for passing the repulsion currents E22, E32 for time U22 by an output signal of the timer TU21, a timer TU4 for generating a lag signal at a start point in time for passing suction currents E16, E26 by an ON signal of the switch 304S, a timer TU23 for generating a pulse for passing repulsion currents E23, E33 by an inversion signal in which an OFF (opening) signal of the switch 304S is inverted by a NOT circuit 414, a timer TU7 for setting a start point in time when attraction currents E27, E37 are passed by the inversion signal, and a timer TU8 for generating a pulse with time U8 based on a signal of the timer TU7.

It is constructed so that by connecting outputs of switches 421, 602, 603, 426, 427 for connecting command values of each command part SE11 to SE13, SE16, SE17 to outputs based on each output signal of each the timer TU1, TU22, TU4, TU23, TUB, the command values of each the command part SE1 etc. are inputted to a current control part 401 as an attraction force command value 407 and also the output signals of each the timer TU1, TU22, TU4, TU23, TUB are inputted to a switch part 403 as a switch control signal 408 through an OR circuit 413 and an inversion OR of the timer TU22 and TU23 is obtained by a NOR circuit 604 to form a switching signal 601.

The switching part 600 electrically switches a voltage polarity of the electromagnet 301B by the switching signal 601, and when the switching signal 601 is high, switches 611, 612 become ON and the switching signal 601 is inverted by a NOT circuit 610, so that switches 613, 614 become OFF and a power source 402 is connected.

Also, when the switching signal 601 is low, the switches 611, 612 become OFF and the switching signal 601 is inverted by the NOT circuit 610, so that the switches 613, 614 become ON and the power source 402 is connected in the opposite polarity of the power source 402.

Figure 18:
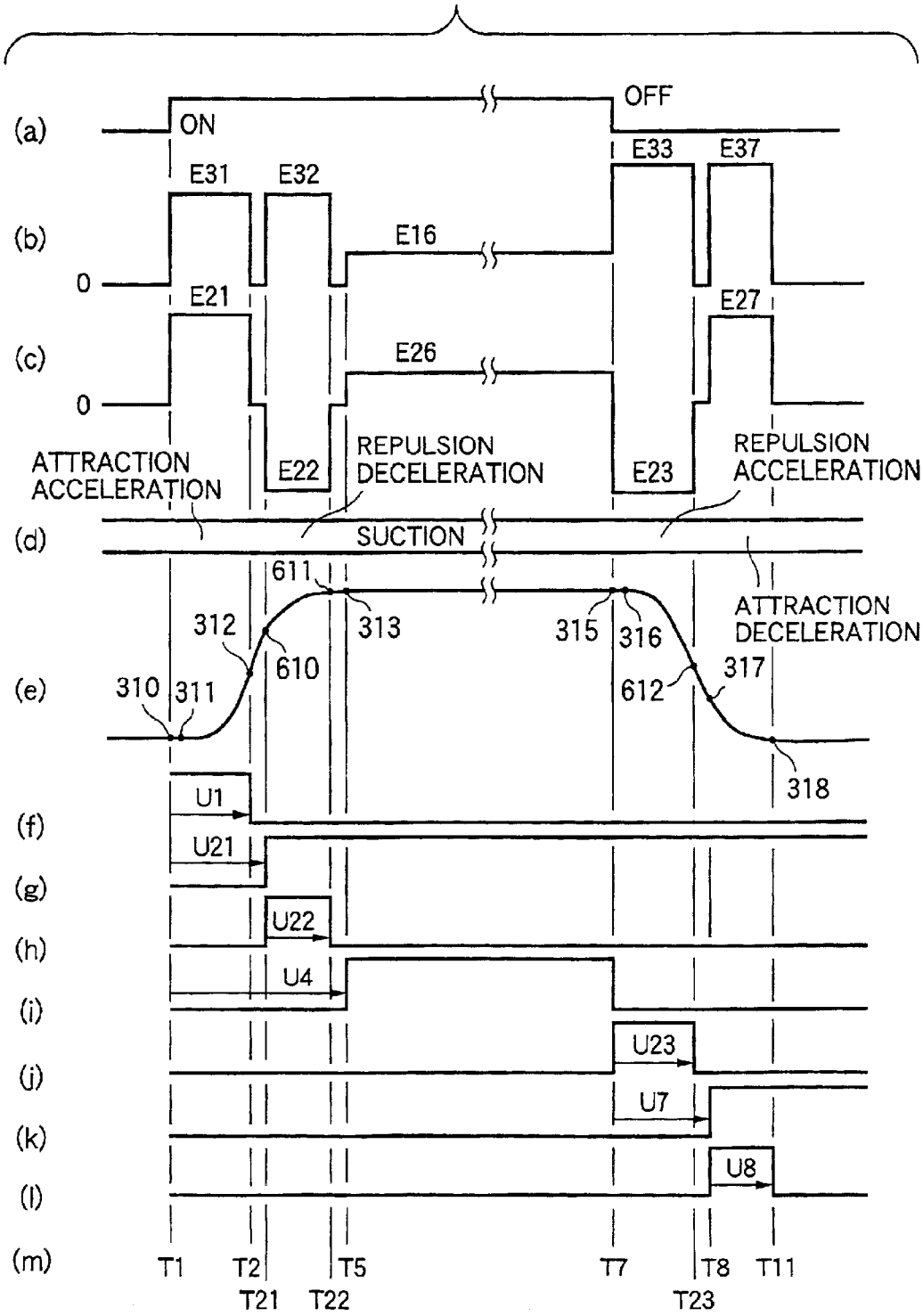
FIG. 18 is a time chart showing waveforms of each part with respect to an operation of an electromagnetic contactor by FIG. 14.

An operation of the electromagnetic contactor constructed as mentioned above will be described by FIGS. 15 to 18. In FIG. 18, (a) shows a signal of the switch 304S and (b) shows a current waveform flowing through the electromagnet 301A and (c) shows a current waveform flowing through the electromagnet 301B and (d) shows an attraction or repulsion state of the movable core 1 and the fixed core 20 and (e) shows movement of the movable core 1 and (f), (g), (h), (i), (j), (k), (l) show an operation of each the timer.

First, a throwing operation of the electromagnetic contactor will be described. At time T1, when the switch 304S becomes ON, the timer TU1 generates a pulse with time U1 and the switch part 403 is turned on by the switch control signal 408 through the OR circuit 413. At the same time, the switch 421 becomes ON and the command part SE11 is provided to the current control part 401 as the attraction force command value 407. Since outputs of the timers TU21, TU22 are a low signal, the switching signal 601 which is an output of the NOR circuit 604 becomes a high signal and the switches 611, 612 of the switching part 600 are turned on and the switches 613, 614 are turned off and currents flowing through the electromagnets 301A, 301B are controlled by the current control part 401.

Therefore, acceleration currents E21, E32 with a pulse shape in the same direction flow through the electromagnets 301A, 301B and strong attraction force occurs between the movable core 1 and the fixed core 20, and the movable core 1 does not move at a point in time of numeral 310 shown in FIG. 18(*e*) and starts acceleration from a point in time of numeral 311 after a while, and a speed increases and at numeral 312 of time T2 after a lapse of time U1, the switch 421 becomes OFF and the attraction force command value 407 is turned off and the current control part 401 becomes OFF to break the acceleration currents E21, E32.

The movable core 1 approaches against repulsion of a trip spring 30 etc. in a direction of the fixed core 20 under inertia and moves to a position of numeral 610. At time T21 of the position, an output of the timer TU21 becomes a high signal and a pulse with time U22 is generated from the timer TU22 and the switch control signal 408 becomes high through the OR circuit 413 to turn on the switch part 403. At the same time, since an output of the timer TU22 is a high signal, a switching signal which is an output of the NOR circuit 604 becomes low, so that the switches 613, 614 of the switching part 600 becomes ON and the switches 611, 612 are turned off and the switch 602 becomes ON and currents flowing through the electromagnets 301A, 301B are controlled by the current control part 401 using the command part SE12 as the attraction force command value 407.

In the position 610 of the movable core 1, by passing a deceleration current E32 through the electromagnet 301A and passing a deceleration current E22 through the electromagnet 301B in a direction opposite to the deceleration current E32 for time U22, the movable core 1 and the fixed core 20 are repulsed and in addition to the repulsion of the trip spring 30 etc., the movable core 1 decelerates rapidly. In the movable core 1, the speed reduces and an output of the timer TU22 becomes a low signal at time T22 of a position 611 in the slightly front moving to a second position, so that the switch 602 becomes OFF and the current control part 401 is turned off and the deceleration currents E32, E22 are broken and the movable core 1 moves under inertia for a period from a position 611 to a position 313.

Here, values of the deceleration currents E32, E22 and values of the time U21, U22 are set so that a speed becomes zero at the position of numeral 313, time T5 of the movable core 1.

Incidentally, the time T22 may match with the time T5.

After a lapse of time U4 since the switch 304S became ON, an output of the timer TU4 becomes a high signal and the switch control signal 408 becomes high through the OR circuit. 413 to turn on the switch part 403. At the same time, the switch 426 becomes ON and the command part SE16 is provided to the current control part 401 as the attraction force command value 407. At the same time, since an output of the timer TU23 is a low signal, a switching signal which is an output of the NOR circuit 604 becomes high and the switches 611, 612 of the switching part 600 become ON and the switches 613, 614 are turned off and currents flowing through the electromagnets 301A, 301B are controlled by the current control part 401.

Therefore, in the position 313 which is substantially the second position of the movable core 1, suction currents E16, E26 of the same direction are passed through the electromagnets 301A, 301B and the movable core 1 is sucked and held to the fixed core 20.

As described above, by an ON signal of the switch 304S, the acceleration currents E31, E21 are passed through the electromagnets 301A, 301B for time U21 in the attraction direction of the movable core 1 and the fixed core 20 and at the time when the movable core 1 reaches a distance close to the fixed core 20, the deceleration currents E32, E22 are passed for time U22 in the repulsion direction of the movable core 1 and the fixed core 20 and at a point in time when the movable core 1 reaches the second position, the suction currents E16, E26 are passed in the attraction direction of the movable core 1 and the fixed core 20, so that throwing time of the electromagnetic contactor is fast and a shock by a collision can be suppressed since it is constructed so that a speed of the movable core 1 is reduced to substantially zero by rapid deceleration and the movable core 1 reaches the fixed core 20.

An operation in the case of opening the electromagnetic contactor constructed as mentioned above will be described by FIGS. 15 to 19. Now, when the switch 304S is turned off at time T7, since an output of the timer TU23 becomes high, the switch 603 becomes ON and the attraction force command value 407 is provided to the current control part 401 from the command part SE7 and an output of the NOR circuit 604 becomes low and the switches 613, 614 of the switching part 600 become ON and acceleration currents E33, E23 are passed for time U23 in the repulsion direction of the movable core 1 and the fixed core 20. Thus, the movable core 1 is repulsed to the fixed core 20 but does not move immediately at a point in time of numeral 315 shown in (e). After a while, acceleration is started from numeral 316 and in addition to the repulsion of the trip spring 30 etc., the repulsion acceleration currents E33, E23 are broken at numeral 612 of time T23 when a speed increases.

At time T8 after a lapse of time U7 since the switch 304S became OFF, the timer TU7 becomes high and the switch part 403 is turned on by the switch control signal 408 through the OR circuit 413. At the same time, since outputs of the timers TU22, TU23 are a low signal, an output of the NOR circuit 604 becomes a high signal and the switches 611, 612 become ON and the switches 613, 614 become OFF and the switch 421 becomes ON and currents flowing through the electromagnets 301A, 301B are controlled by the current control part 401 using the command part SE11 as the attraction force command value 407.

At the time T8 of a position 317 of the movable core 1, a deceleration current E37 is passed through the electromagnet 301A and a deceleration current E27 is passed through the electromagnet 301B in the same direction as to the deceleration current E37 for time U8. Attraction force acts to the movable core 1 to a point in time of numeral 318 and the movable core 1 decelerates. Since an output of the timer TU8 becomes a low signal at time T11 which is a first position 318 of the movable core 1, the switch 427 becomes OFF and the current control part 401 is turned off and the deceleration currents E37, E27 are broken and the movable core 1 maintains a release state by the trip spring 30 etc. smoothly.

Here, since a speed of the movable core 1 has become slow at the time T11, a shock speed becomes low even in the case of some deviation backward and forward.

Therefore, by an OFF signal of the switch 304S, the suction currents E16, E26 flowing through the electromagnets 301A, 301B are broken and then the acceleration currents E33, E23 are passed for time U23 in the repulsion direction of the movable core 1 and the fixed core 20 and then the deceleration currents E37, E27 are passed through the electromagnets 301A, 301B for time U8 in the attraction direction of the movable core 1 and the fixed core 20 after time U7 and at a point in time when the movable core 1 reaches the first position, the deceleration currents E37, E27 are broken, so that releasing time of the electromagnetic contactor is fast and a shock by a collision is suppressed and a contact can break or throw a current rapidly, so that arcing time becomes short and melt or damage due to arc heat is small and a life of the contact extends.

As described above, according to a first invention, there are effects that a shock in the case of throwing and opening an electromagnetic contactor can be suppressed and a shock sound becomes small and chattering of an electric contact reduces.

According to a second or fourth invention, there are effects that a shock in the case of throwing an electromagnetic contactor can be suppressed and a shock sound becomes small and chattering of an electric contact reduces.

According to a third or fifth invention, there are effects that a shock in the case of opening an electromagnetic contactor can be suppressed and a shock sound becomes small and chattering of an electric contact reduces.

According to a sixth invention, there are effects that attraction between a movable core and a fixed core becomes sure more in the case of an electromagnetic contactor in addition to the effects of the second or fourth invention.

According to a seventh invention, there are effects that a shock in the case of throwing a movable core can be suppressed so as to resist variations in a voltage change, a part constant, etc. and chattering of an electric contact reduces since a slope of a speed at the time when a movable core approaches a second position is decreased in the case of throwing an electromagnetic contactor.

According to an eighth invention, there are effects that a shock in the case of throwing a movable core can be suppressed so as to resist variations in a voltage change, a part constant, etc. and chattering of an electric contact reduces since a slope of a speed at the time when a movable core approaches a second position is decreased in the case of opening an electromagnetic contactor.

According to a ninth invention, there are effects that a change in voltage or a change in temperature is resisted in addition to any of the effects of the first to eighth invention.

According to a tenth invention, there are effects that a shock in the case of throwing an AC drive type electromagnetic contactor can be suppressed and a shock sound becomes small and chattering of an electric contact reduces.

According to an eleventh invention, there are effects that a shock in the case of opening an AC drive type electromagnetic contactor can be suppressed and a shock sound becomes small and chattering of an electric contact reduces.

According to a twelfth invention, there are effects that a shock in the case of throwing a movable core can be suppressed while shortening operating time in the case of throwing an electromagnetic contactor and a shock sound becomes small and chattering of an electric contact reduces.

According to a thirteenth invention, there are effects that a shock in the case of throwing a movable core can be suppressed while shortening operating time in the case of opening an electromagnetic contactor and a shock sound becomes small and chattering of an electric contact reduces.

INDUSTRIAL APPLICABILITY

As described above, an electromagnetic contactor according to this invention is suitable for reducing a shock in the case of throwing and opening.

What is claimed is:

1. An electromagnetic contactor for opening or closing a contact by controlling energization of an electromagnet to move a movable core from a first position to a second position with respect to a fixed core, the electromagnetic contactor comprising:

attraction force control means for controlling an integral value of a current flowing through the electromagnet for a predetermined time so that velocity in the second position of the movable core becomes zero;

wherein said attraction force control means contains switches and timers operable to pass current through said electromagnet only during said predetermined time;

wherein said predetermined time is less than a time needed for said movable core to move from said first position to said second position; and wherein said attraction force control means prevents current from passing through said electromagnet after said predetermined time until said movable core reaches said second position.

2. An electromagnetic contactor for passing a current through an electromagnet from a power source and moving a movable core from a first position in which a gap to a fixed core is wide to a second position in which the gap is narrow by electromagnetic force and opening or closing a contact, the electromagnetic contactor comprising:

attraction force control means for passing a first current through the electromagnet for a predetermined time so that velocity in the second position of the movable core becomes zero and passing a second current through the electromagnet when said movable core reaches the second position, wherein said predetermined time is less than a time needed for said movable core to move from said first position to said second position; and wherein said attraction force control means passes the second current to attract and hold said electromagnet after said predetermined time when said movable core reaches said second position.

3. An electromagnetic contactor for breaking a current flowing through an electromagnet from a power source and moving a movable core from a second position in which a gap to a fixed core is narrow to a first position in which the gap is wide and opening or closing a contact, the electromagnetic contactor comprising:

attraction force control means for breaking the current flowing through the electromagnet and then passing a deceleration current through the electromagnet for a second predetermined time after a first predetermined time so that velocity in the first position of the movable core becomes zero; and wherein said first predetermined time is less than a time needed for said movable core to move from said second position to said first position; and wherein said attraction force control means passes the current through said electromagnet for the second predetermined time after said first predetermined time until said movable core is substantially in said first position.

4. An electromagnetic contactor for passing a current through an electromagnet from a power source and moving a movable core from a first position in which a gap to a fixed core is wide to a second position in which the gap is narrow by electromagnetic force and opening or closing a contact, the electromagnetic contactor comprising:

current control means for controlling the current flowing through the electromagnet; and command means for passing a first current through the electromagnet for a predetermined time by the current control means so that velocity in the second position of the movable core becomes zero, and then passing a second current through the electromagnet by the current control means when the movable core reaches the second position; and wherein said predetermined time is less than a time needed for said movable core to move from said first position to said second position; and wherein said current control means prevents current from passing through said electromagnet after said predetermined time until said movable core is substantially in said second position.

5. An electromagnetic contactor for breaking a current flowing through an electromagnet from a power source and moving a movable core from a second position in which a gap to a fixed core is narrow to a first position in which the gap is wide and opening or closing a contact, the electromagnetic contactor comprising:

current control means for controlling the current flowing through the electromagnet; and command means for breaking the current flowing through the electromagnet by the current control means, then passing a deceleration current through the electromagnet for a predetermined time by the current control means after a predetermined lapse so that velocity in the first position of the movable core becomes zero, and then breaking the deceleration current by the current control means at the time when the movable core moves to substantially the first position; and wherein said predetermined time is less than a time needed for said movable core to move from said second position to said first position.

6. The electromagnetic contactor as defined in claim 2, wherein said second current is greater than a holding current value necessary to hold the movable core in the second position during an initial predetermined time, and wherein said second current is equal to the holding current value after the predetermined time.

7. An electromagnetic contactor for passing a current through an electromagnet from a power source and moving a movable core from a first position in which a gap to a fixed core is wide to a second position in which the gap is narrow by electromagnetic force and opening or closing a contact, the electromagnetic contactor comprising:

current control means for controlling the current flowing through the electromagnet; and command means for passing a first current through the electromagnet for a first predetermined time by the current control means so that velocity of the movable core becomes zero slightly in front of the second position, then passing a second current having a value lower than the first current through the electromagnet for a second predetermined time by the current control means when the movable core moves slightly in front of the second position, and then passing a third current through the electromagnet by the current control means at a time when the movable core reaches the second position;

wherein said command means prevents current flow through the electromagnet after said first predetermined time and before said second current passes.

8. An electromagnetic contactor for breaking a current flowing through an electromagnet from a power source and moving a movable core from a second position in which a gap to a fixed core is narrow to a first position in which the gap is wide and opening or closing a contact, the electromagnetic contactor comprising current control means for controlling the current flowing through the electromagnet; and command means for breaking the current flowing through the electromagnet by the current control means, then passing a first deceleration current through the electromagnet for a first predetermined time by the current control means after a first lapse so that velocity of the movable core becomes zero slightly in front of the first position, passing a second deceleration current for a second predetermined time by the current control means at a time when the movable core moves to slightly in front of the first position, and then breaking the second deceleration current by the current control means at a time when the movable core reaches the first position; and wherein said command means prevents current flow through the electromagnet after the current control means breaks the current flowing through the electromagnet and before said first deceleration current passes.

9. The electromagnetic contactor as claimed in any of claims 4–8, wherein a command of the command means has a predetermined slope in a rise or a fall of a current.

10. An electromagnetic contactor for passing a current through an electromagnet from an AC power source and moving a movable core from a first position in which a gap to a fixed core is wide to a second position in which the gap is narrow by electromagnetic force and opening or closing a contact, the electromagnetic contactor comprising:

phase control means for shifting the AC power source from OFF to ON at a predetermined voltage phase based on a command from command means; and command means for turning on the phase control means with a predetermined voltage phase to apply a voltage to the electromagnet for a predetermined time so that velocity of the movable core becomes zero at the second position, and then turning off the phase control means after said predetermined time;

wherein said predetermined time is less than a time needed for said movable core to move from said first position to said second position.

11. An electromagnetic contactor for breaking a current through an electromagnet from an AC power source and moving a movable core from a second position in which a gap to a fixed core is narrow to a first position in which the gap is wide and opening or closing a contact, the electromagnetic contactor comprising:

phase control means for turning on or off the AC voltage applied to the electromagnet;

command means for turning off the phase control means with a predetermined voltage phase, then turning on the phase control means when the movable core is slightly before the first position, then applying a voltage for a predetermined time to the electromagnet so that acceleration of the movable core becomes zero, and then turning off the phase control means; and wherein said predetermined time is less than a time needed for said movable core to move from said second position to said first position.

12. An electromagnetic contactor for breaking a current flowing through an electromagnet from a power source and moving a movable core from a first position in which a gap to a fixed core is wide to a second position in which the gap is narrow and opening or closing a contact, wherein the electromagnet comprises a first electromagnet for exciting the fixed core and a second electromagnet for exciting the movable core, the electromagnetic contactor comprising:

current control means for controlling the current flowing through the first and second electromagnets;

switching means for switching electromagnetic force occurring in the movable core and the fixed core to attraction or repulsion by switching a direction of the current flowing through the first or second electromagnet; and command means for passing a first attraction current through the first and second electromagnets for a first predetermined time, then passing a first repulsion current through the first and second electromagnets for a second predetermined time when the movable core approaches the second position, and then passing a second attraction current through the first and second electromagnets when the movable core moves to the second position.

13. An electromagnetic contactor for breaking a current flowing through an electromagnet from a power source and moving a movable core from a second position in which a gap to a fixed core is narrow to a first position in which the gap is wide and opening or closing a contact, wherein the electromagnet comprises a first electromagnet for exciting the fixed core and a second electromagnet for exciting the movable core, the electromagnetic contactor comprising:

switching means for switching electromagnetic force occurring in the movable core and the fixed core to attraction or repulsion by switching a direction of the current flowing through the first or second electromagnet; and command means for passing a first repulsion current through the first and second electromagnets for a first predetermined time, then passing a first attraction current through the first and second electromagnets for a second predetermined time, and then breaking the first attraction current when the movable core moves to the first position.

14. The electromagnetic contactor as defined in claim 4, wherein said second current is greater than a holding current value necessary to hold the movable core in the second position for an initial predetermined time, and wherein said second current is equal to the holding current value after the predetermined time.

* * * * *